US007448320B2

(12) United States Patent
Masuch et al.

(10) Patent No.: US 7,448,320 B2
(45) Date of Patent: Nov. 11, 2008

(54) PRINTING UNIT AND A ROTARY ROLLER PRINTING PRESS

(75) Inventors: Bernd Kurt Masuch, Kürnach (DE); Karl Robert Schäfer, Rimpar (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 78 days.

(21) Appl. No.: 11/589,105

(22) Filed: Oct. 30, 2006

(65) Prior Publication Data

US 2007/0068405 A1 Mar. 29, 2007

Related U.S. Application Data

(62) Division of application No. 10/490,377, filed as application No. PCT/DE02/03692 on Sep. 30, 2002, now Pat. No. 7,159,512.

(30) Foreign Application Priority Data

| | | |
|---|---|---|
| Oct. 5, 2001 | (DE) | 101 49 068 |
| Oct. 11, 2001 | (DE) | 101 49 997 |
| Jan. 18, 2002 | (DE) | 102 02 033 |
| Mar. 26, 2002 | (DE) | 102 28 968 |
| Jun. 26, 2002 | (DE) | 102 28 970 |
| Jul. 3, 2002 | (WO) | PCT/DE02/02410 |
| Jul. 5, 2002 | (DE) | 102 30 316 |
| Aug. 2, 2002 | (DE) | 102 35 391 |
| Aug. 21, 2002 | (DE) | 102 38 177 |

(51) Int. Cl.
*B41F 5/16* (2006.01)
*B41F 27/00* (2006.01)

(52) U.S. Cl. ..... 101/178; 101/217; 101/219; 101/382.1

(58) Field of Classification Search ..... 101/178, 101/179, 180, 216, 217, 219, 220, 221, 222, 101/230, 232, 382.1
See application file for complete search history.

(56) References Cited

U.S. PATENT DOCUMENTS 1,442,178 A 1/1923 Raabe (Continued)

FOREIGN PATENT DOCUMENTS

DE 2 220 652 11/1973

(Continued)

OTHER PUBLICATIONS

Mannesmann Rexroth, "SYNAX Dezentrales System zur Synchronisierung von Maschinenachsen," Indramat GmbH, 1998.

(Continued)

*Primary Examiner*—Ren Yan
(74) *Attorney, Agent, or Firm*—Jones, Tullar & Cooper, PC

(57) ABSTRACT

A printing unit is comprised of at least two pairs of two cylinders each. The two cylinders in each pair are a transfer cylinder and a forme cylinder. The transfer cylinder and the forme cylinder are each embodied with a width sufficient for printing six newspaper pages arranged axially next to each other. The transfer cylinder of each pair cooperates with a counter-pressure cylinder, that is embodied as a satellite cylinder to form a printing head in a so-called print-in-place arrangement.

12 Claims, 18 Drawing Sheets

U.S. PATENT DOCUMENTS

| | | | | |
|---|---|---|---|---|
| 3,824,928 | A | | 7/1974 | Langer |
| 3,942,782 | A | | 3/1976 | Hermach |
| 4,606,269 | A | | 8/1986 | Jeschke et al. |
| 4,671,501 | A | | 6/1987 | Fujishiro |
| 5,179,899 | A | | 1/1993 | Burger et al. |
| 5,303,909 | A | | 4/1994 | Maylaender |
| 5,309,834 | A | | 5/1994 | Koch |
| 5,375,520 | A | | 12/1994 | Kobler et al. |
| 5,413,039 | A | | 5/1995 | Sohma |
| 5,553,545 | A | * | 9/1996 | Turner ..... 101/415.1 |
| 5,617,792 | A | | 4/1997 | Rau et al. |
| 5,687,648 | A | | 11/1997 | Puschnerat et al. |
| 5,775,222 | A | | 7/1998 | Zweifel et al. |
| 5,778,779 | A | | 7/1998 | Jones et al. |
| 5,806,431 | A | | 9/1998 | Muth |
| 5,809,890 | A | | 9/1998 | Knauer et al. |
| 5,947,023 | A | | 9/1999 | Bohrer et al. |
| 5,953,991 | A | | 9/1999 | Geissenberger et al. |
| 6,024,684 | A | | 2/2000 | Maylander et al. |
| 6,062,138 | A | | 5/2000 | Fromson et al. |
| 6,152,034 | A | | 11/2000 | Dufour |
| 6,199,280 | B1 | | 3/2001 | Schneider et al. |
| 6,298,781 | B1 | | 10/2001 | Dufour |
| 6,332,397 | B1 | | 12/2001 | Bolza-Schunemann et al. |
| 6,334,389 | B1 | | 1/2002 | Fischer |
| 6,338,298 | B2 | | 1/2002 | Schneider et al. |
| 6,408,747 | B2 | | 6/2002 | Koppelkamm et al. |
| 6,408,748 | B1 | | 6/2002 | Hajek et al. |
| 6,422,552 | B1 | | 7/2002 | Chesno et al. |
| 6,532,872 | B2 | | 3/2003 | Siegl et al. |
| 6,615,731 | B2 | | 9/2003 | Dumais et al. |
| 6,644,184 | B1 | | 11/2003 | Hajek et al. |
| 6,647,874 | B1 | | 11/2003 | Siegl et al. |
| 6,920,824 | B2 | | 7/2005 | Holm |
| 7,156,019 | B2 | | 1/2007 | Herbert et al. |
| 2001/0037737 | A1 | | 11/2001 | Koppelkamm et al. |
| 2002/0189470 | A1 | | 12/2002 | Holm |
| 2003/0075640 | A1 | | 4/2003 | Weis |
| 2003/0167946 | A1 | | 9/2003 | Schneider et al. |

FOREIGN PATENT DOCUMENTS

| | | | |
|---|---|---|---|
| DE | 25 10 057 | | 9/1975 |
| DE | 2422696 | C2 | 11/1975 |
| DE | 25 28 008 | | 1/1976 |
| DE | 34 09 194 | | 9/1985 |
| DE | 41 28 797 | A1 | 3/1993 |
| DE | 44 19 217 | A1 | 12/1995 |
| DE | 44 30 693 | A1 | 3/1996 |
| DE | 44 40 239 | C2 | 5/1996 |
| DE | 197 01 046 | C2 | 7/1997 |
| DE | 19639800 | | 2/1998 |
| DE | 196 20 997 | | 3/1998 |
| DE | 197 20 952 | A1 | 11/1998 |
| DE | 197 23 043 | A1 | 12/1998 |
| DE | 198 03 809 | A1 | 8/1999 |
| DE | 100 16 409 | A1 | 6/2001 |
| DE | 100 01 328 | A1 | 7/2001 |
| DE | 100 24 329 | A1 | 11/2001 |
| DE | 101 20 134 | A1 | 11/2001 |
| DE | 299 24 330 | U1 | 10/2002 |
| DE | 100 66 162 | | 8/2004 |
| EP | 0 567 741 | B2 | 11/1993 |
| EP | 0 585 625 | A1 | 3/1994 |
| EP | 0 638 419 | | 6/1994 |
| EP | 0 644 048 | | 12/1994 |
| EP | 0 699 524 | A2 | 3/1996 |
| EP | 0 712 725 | A2 | 5/1996 |
| EP | 0 878 299 | | 4/1998 |
| EP | 1 233 862 | | 12/2000 |
| EP | 1 072 551 | A2 | 1/2001 |
| GB | 1 476 707 | | 6/1977 |
| JP | 51-24309 | | 6/1977 |
| JP | 53-100009 | | 9/1978 |
| JP | 56-21860 | | 2/1981 |
| JP | 2-196658 | | 8/1990 |
| JP | 6-39993 | | 2/1994 |
| JP | 09-099543 | | 4/1997 |
| JP | 10-071694 | | 3/1998 |
| JP | 2000-512932 | | 10/2000 |
| JP | 3204991 | | 6/2001 |
| JP | 3215398 | | 7/2001 |
| JP | 2001-512063 | | 8/2001 |
| JP | 2005-504667 | | 2/2005 |
| WO | WO 97/11848 | | 4/1997 |
| WO | WO 97/17200 | | 5/1997 |
| WO | WO 01/70608 | A1 | 9/2001 |
| WO | WO 01/87613 | A1 | 11/2001 |

OTHER PUBLICATIONS

Mannesmann Rexroth, "SYNAX Decentralized System for the Synchronization of Machine Axes," Indramat GmbH, 1998.
Man Roland, Colorman 16-Seiten-Zeitungsoffset.
Man Roland, Co-operating for Success; Charts 2 and 19.
Colorman Grossauftrag; MGW/Presse/Gerhard Konrad, Oct. 1, 1997.
Press kit ifraEXPO 2000, Man Roland, Oct. 9, 2000.
"IFRA Expo 2000: Messe der Fachgesprache," Technik, IFRA Expo 2000; Offset-/Zeitungsdruck; g14-g16.
"Heidelberg kundigt neue dreifachbreite Zeitungs-Offset-Rotation an," Heidelberger Druckmaschinen Ag, pp. 1-4.
Zeitungsformat aus Wikipedia, der freien Enzyklopadie, 3 pp.
Walenski, "Der Rollen Offset druck, Geschichte Moderne Technik Materialien," 1995, Fachschriften-Verlag GmbH & Co Kg; Intro plus pp. 336-339.
Juhasz, Kevin; Heidelberg Introduces Triple-Width Newspaper Press; Newspapers & Technology; Dec. 2000; 4 pp.; Germany.
Fuchs, Boris, ""Wie viele Platten pro Cylinder?"," Schwerpunkt, (Jan. 10, 2000).
"Tristream—doppelt und dreitach"—Nov. 2000.
Newspaper Techniques—Sep. 1991—"Six-Wide Newspaper Presses—History and Facts".
Newspaper Techniques—Oct. 1991—"KBA Journal, a "Little Sister" for the Commander and Express".

* cited by examiner

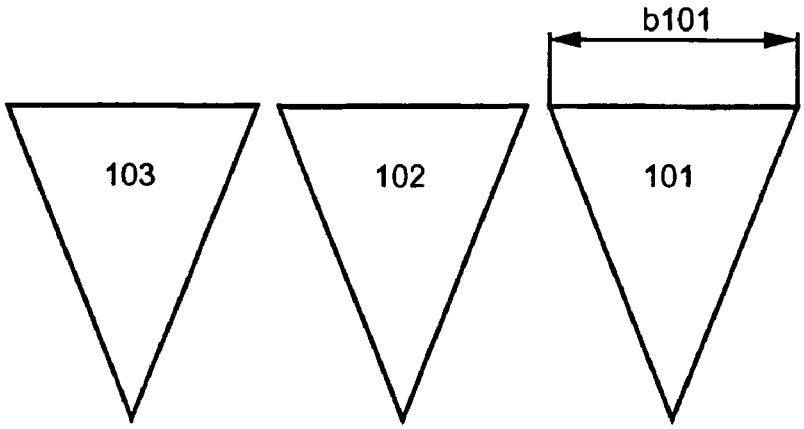
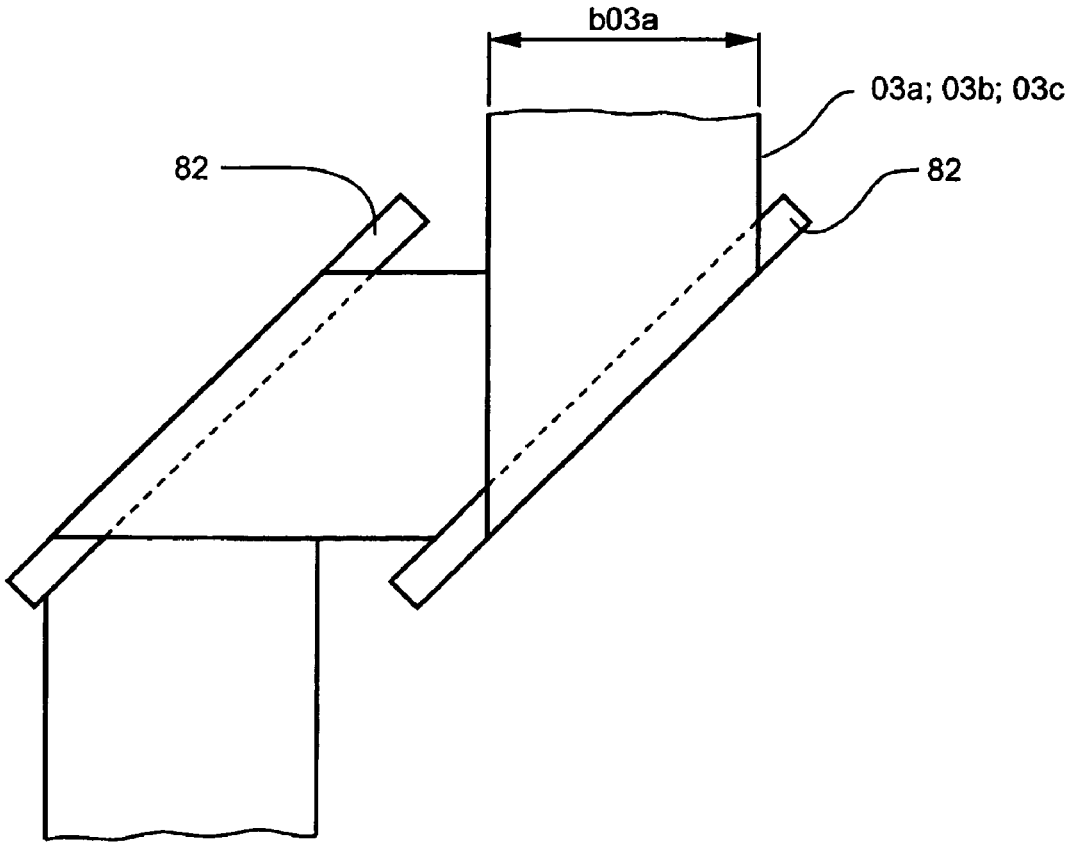
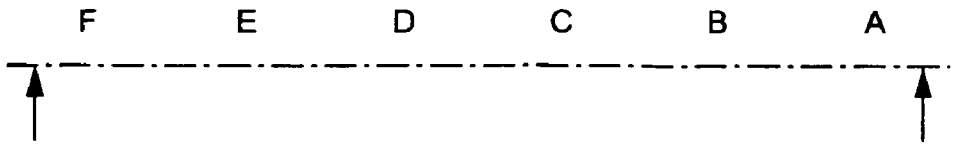
Fig. 16
Fig. 17
Fig. 15

PRINTING UNIT AND A ROTARY ROLLER PRINTING PRESS

CROSS-REFERENCE TO RELATED APPLICATIONS

This U.S. patent application is a division of U.S. patent application Ser. No. 10/490,377, filed Apr. 2, 2004 and now U.S. Pat. No. 7,159,512, issued Jan. 9, 2007. That application was the U.S. national phase of PCT/DE02/03692, filed Sep. 30, 2002 and published as WO 03/031180 A2 on Apr. 17, 2003. The PCT application claims priority to nine prior German and PCT applications, the earliest of which was filed on May 10, 2001 and all of which are listed on the Declaration filed with this application. The disclosures of these various documents are expressly incorporated herein by reference.

FIELD OF THE INVENTION

The present invention is directed to a printing unit and to a web-fed rotary printing press. The printing unit has at least two pairs of two cylinders each.

BACKGROUND OF THE INVENTION

DE 25 28 008 A1 shows a printing press for a direct printing method, and having forme cylinders which can be equipped with six printing plates in the axial direction, and with two printing plates in the circumferential direction, and having counter-pressure cylinders which can be supplied with three printing blankets in the axial direction, and with one printing blanket in the circumferential direction. The printing plates, which are arranged side- by-side, as well as the printing blankets, which are arranged side-by-side, are each arranged offset in the circumferential direction.

DE 25 10 057 A1 also discloses a printing press for the direct printing method. The forme cylinder, which works together with a counter-pressure cylinder, supports six printing plates over its width and two printing plates on its circumference.

A printing group with forme, transfer and counter-pressure cylinders is known from JP 56-021860 A. Each one of the three cylinders is driven by its own drive motor.

A triple-width web-fed rotary printing press, with two formers arranged on two levels, that are located one on top of the other, is known from DE 41 28 797 A1.

A printing press with printing groups of a width of six newspaper pages is known from "Newspapers & Technology", Dec. 2000. The printing groups are configured as bridge printing groups. The transfer cylinders are covered by rubber blanket sleeves.

WO 01/70608 A1 discloses a turning bar arrangement, in which two turning bars, which are substantially of a partial web width, are displaceably arranged on a support transversely to the direction of the incoming partial web. A register roller is arranged at the respective sides outside of the lateral frames. Its longitudinal axis extends substantially parallel with the lateral frame. It can also be displaced along a rail in a direction transverse to the direction of the incoming partial web.

A folding assembly is known from U.S. Pat. No. 4,671,501. Two formers are arranged above one another wherein, after passing over lead rollers, webs are linearly cut ahead of a third former, the partial webs are turned by 90° via a third former, and are subsequently combined into two strands and are conducted to the two formers which are arranged above one another.

A folding assembly with two groups of formers, which are offset with respect to each other, is known from EP 1 072 551 A2. A harp, i.e. a group of collection, receiving or harp rollers, is arranged above each of the groups of formers, over which the respective partial webs are conducted to the assigned groups of formers.

A folding assembly is known from WO 97/17200 A2. Cut partial webs, which are offset transversely with respect to each other, are conducted to various formers. The formers, that are arranged horizontally side-by-side, are also partially arranged vertically offset with respect to each other.

DE 44 19 217 A1 shows a superstructure of a web-fed rotary printing press with a turning device. Partial webs are offset by one-half of a partial web width in order to conduct them on top of each other and to a common former.

A six newspaper pages wide bridge printing group and a three-cylinder printing group are disclosed in DE 100 16 409 A1. The covering of the transfer cylinder with rubber blankets is alternating. The opening in the area of the shell surface has a width of, for example, between 1 and 3 mm in the circumferential direction.

DE 198 03 809 A1 D1 discloses a printing group for four pages in newspaper format or for more, for example six or eight printed pages, located side-by-side, in book format.

DE 101 20 134 A1 discloses, printing forme sections positioned side-by-side and in section a segment, independent from the other segment, for use in pressing on or holding a dressing.

SUMMARY OF THE INVENTION

The object of the present invention is directed to providing a printing unit and to providing a web-fed rotary printing press.

In accordance with the present invention, this object is attained by the provision of a printing unit having at least two pairs of two cylinders each. Each pair includes a transfer cylinder and a forme cylinder. Both the transfer cylinder and the forme cylinder have a width sufficient to print six newspaper pages arranged axially side-by-side. A web-fed rotary printing press can have two of these printing units, with each such printing unit having four cylinder pairs. Each such cylinder pair consists of a transfer cylinder and a forme cylinder. The two printing units are each embodied as satellite printing units.

The advantages to be gained by the present invention rest, in particular, in that a simple, cost-effective and space-saving construction, together with the provision of a high variability of the product or intermediate product, is made possible.

Advantages also lie, in particular, in that, in comparison to double-width printing presses, the production dependability is considerably increased with the same target size of a product. Also, when retaining the number of printing units, the yield of the printing press, or of each printing group, can be increased by 50%.

The number of roll changers, and their associated investment costs, the frequency of roll changes and the resultant loss of production dependability, as well as the set-up time when drawing in webs and the increase in cycle times, can all be reduced for the same production size in comparison with a double-width printing press.

In an advantageous embodiment, the printing units are structured as nine-cylinder satellite printing units, which results in high precision of the ink register, and otherwise in a low-oscillation construction. Oscillations are also reduced by the advantageous arrangement, structure and fastening of dressings on the cylinders. For one, openings on the shell surface in the circumferential direction are minimized. It is furthermore also possible to arrange the openings, at least on the transfer cylinder, alternatingly offset in the circumferential direction, in such a way, that a closed shell surface always works together with the forme or satellite cylinder, at least over the length of a section of the forme or satellite cylinder. Thirdly, out-of-roundness and production costs are minimized because, although channels which are axially dispersed on the barrel over its entire effective length are provided, openings in the direction toward the shell surface only exist in the mentioned sections. Devices for fastening of dressing ends and/or fillers are selectively inserted into the channels.

At least six devices for the axial positioning of printing formes are arranged in the channel or channels of the forme cylinders. These devices are embodied, for example, as register pins that are positively acting together with the printing forme ends, which are arranged inside the channel and which can be axially movable manually or by remote control.

For equipping the forme cylinders with printing formes which can be reproduced with exact registration and color congruence, the configuration of the printing groups with associated pressing devices is advantageous. Because of these, it is possible to fix dressings, resting on the shell surface of the cylinders, in place by use of respectively at least one pressing element, as needed, while one end of a dressing or of several dressings is or are released for being removed or attached.

The drive mechanism of the satellite cylinder, or cylinders, which is mechanically independent of the pairs of cylinders, offers particular advantages, with respect to a possibility of a variable operation. Thus it is possible, for example, to perform a set-up operation during production, for example a flying printing forme change, or a forme washing. On the other hand, a web can be drawn in while other cylinders, or other pairs of cylinders, are stopped or are being cycled through a set-up program. If rubber blankets, with positively or negatively conveying properties, are present, it is also advantageous to operate the satellite cylinder with a surface speed which differs from that of the remaining cylinders.

In an advantageous embodiment of the present invention, a superstructure of the printing press has at least one longitudinal cutting device with at least five cutters, which cutters are spaced apart from each other transversely to the paper conveying direction. In an advantageous embodiment, two register elements, which can be moved transversely, with respect to the paper conveying direction, are provided for each printing tower, or respectively for each eight print positions, for compensating for the paths of the partial webs. In a further development, these register elements can be structurally connected with respective turning devices, each of the width of a partial web. Also, subsequent guide elements, which are only assigned to partial webs, are, for example, substantially embodied to have only a partial web width. These configurations make possible a low-oscillation, and therefore also an exactly matching conveyance of the web. Fluctuations in the web tension, occurring, for example during load changes, or during a change of the printing speed, and caused by the inertia of long, thick guide elements only driven by the partial web or webs, can be effectively-reduced.

With a view to dependable operation and to a cost-saving construction, it is also advantageous to provide the possibility of turning a partial web by an odd-numbered multiple of half a partial web in the superstructure. With this, the draw-in and imprinting of partial webs of half a former width, for example a newspaper page can be omitted.

In connection with the reduction of costs and for providing a space-saving construction, it is advantageous, in one embodiment, to place a so-called harp, i.e. a plurality of lead rollers which, as a rule, are not driven, ahead of only one of two formers, which are themselves arranged above one another. Webs can be transported from the harp to the other former. Strands of variable sizes or numbers of partial webs of the same alignment can be supplied to the two formers which are arranged vertically above one another.

In one preferred embodiment, partial webs from one harp assigned to the one group of formers can be supplied to the other group of formers, and vice versa. In an advantageous embodiment, a so-called harp, i.e. a plurality of lead rollers, which are also called collecting or receiving rollers, is to be placed ahead of only one of two formers that are arranged above each other. Webs from the common harp can then be transferred to the other former. Strands of variable size, or numbers of partial webs of the same alignment, can be supplied to the two formers which are arranged vertically above one another.

In an advantageous embodiment of a turning device, the partial web can be displaced, or is displaced, only by an odd-numbered multiple of half a partial web. In this way, it is possible, with little outlay, to avoid, for example, to have to imprint very narrow webs, or to provide additional printing units. The construction of at least one of the turning bars, which at least one bar can be moved transversely in respect to the web, allows a large amount of variability.

The drive mechanism of rollers of the structure of the former and/or of the folding apparatus, which drive mechanism is mechanically independent from the printing units, is advantageous. This is the case particularly in respect to good registration and variable operation.

BRIEF DESCRIPTION OF THE DRAWINGS

Preferred embodiments of the present invention are represented in the drawings and will be described in greater detail in what follows.

Shown are in:

FIG. 1, a web-fed rotary printing press in a lateral view, in

FIG. 2, a schematic side view of a printing group, in

FIG. 3, a schematic top plan view of a printing group, in

FIG. 4, a cylinder dressing or cover, in a perspective representation, in

DESCRIPTION OF THE PREFERRED EMBODIMENTS

Figure 1:
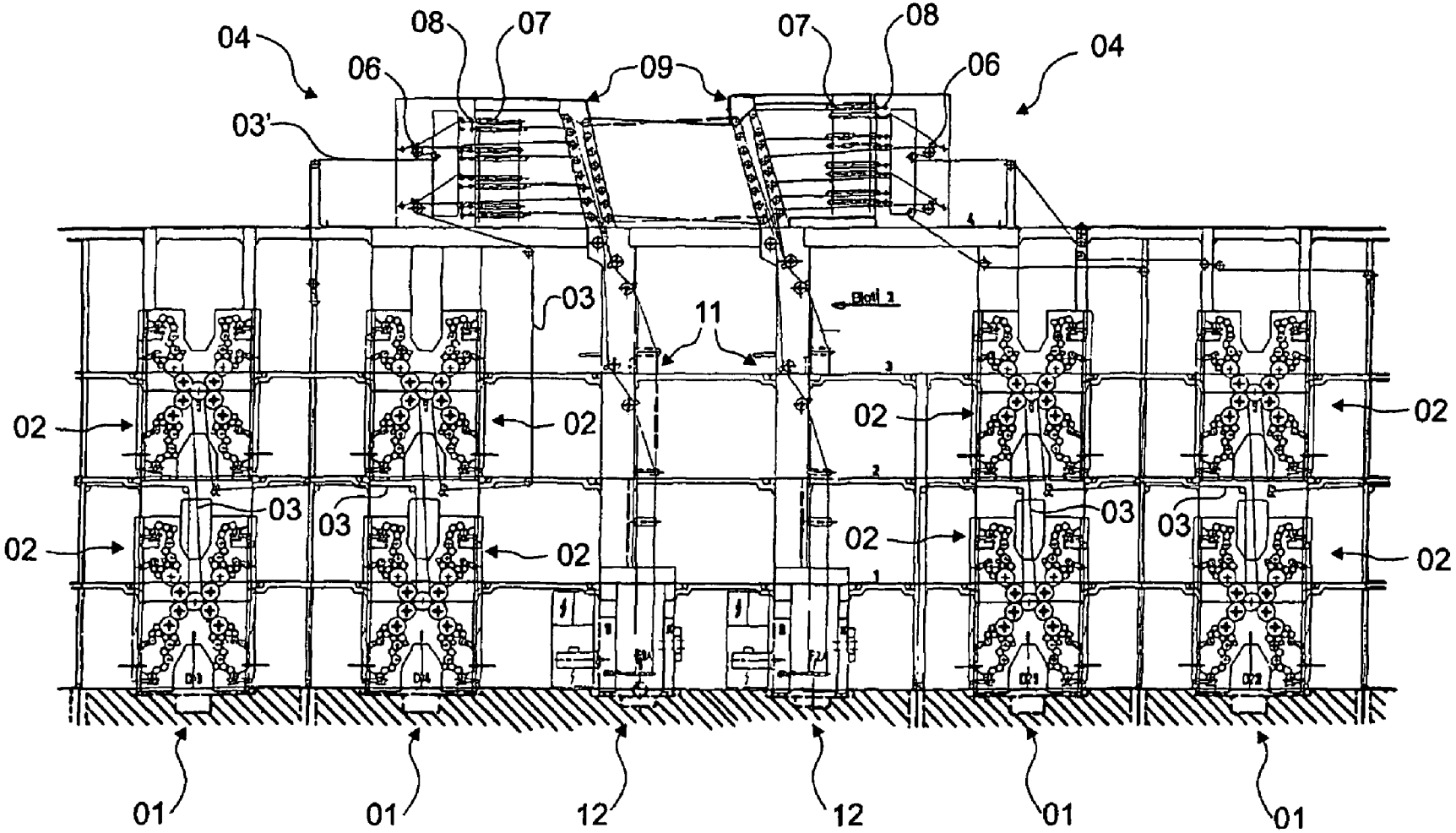

A web-fed rotary printing press in accordance with the present invention, and represented, by way of example, in FIG. 1, has a left press section and a right press section, each section having at least two printing towers 01. The printing towers 01 each have printing units 02 which are embodied to be, for example, at least of triple width, i.e. are configured for the imprinting, of respectively, six newspaper pages, which are arranged axially side-by-side. The printing units 02 are each embodied as satellite printing units 02. The advantageous embodiment of each of the printing units 02 as a nine-cylinder satellite printing unit 02 assures a very good maintenance of color congruence, or a very small fan-out. The printing units 02 can also be embodied as ten-cylinder satellite printing units 02, or possibly can also be embodied as printing units which can be operated in rubber-against-rubber printing, such as, for example, as several bridge printing units or as an H-printing unit 02. Webs 03 from rolls, which are not specifically represented, are supplied to the printing units 02, in particular by the use of roll changers which are also not specifically shown.

One superstructure 04 for each section is provided downstream, in the direction of travel of a web 03 which is passing through the printing towers 01, or printing units 02, in this case, superstructure 04 is situated above the printing towers 01, and in which superstructure 04 the web 03, or the webs 03, are cut by longitudinal cutting arrangements 06. The resultant partial webs can possibly be offset and/or cambered, the linear register of the partial webs can be aligned by the use of register arrangements 08, only depicted schematically in FIG. 1, and these partial webs can be guided above each other. Downstream, as viewed in the web running direction, the superstructure 04 has at least one so-called harp 09 including a plurality of harp or lead rollers, which are arranged above each other and which guide the webs 03, or the partial webs 03*a*, 03*b*, 03*c*. The harp 09 determines the entry into the former of the webs 03 or of the partial webs that are conducted above each other. The webs 03 or partial webs undergo a change in direction as they pass through this harp 09, and are thereafter combined into either one strand, or several strands, and are conducted to at least one folding structure 11.

In the printing press shown in FIG. 1, two folding structures 11 are arranged between the two press sections, which two folding structures 11 each have formers respectively arranged, on two different levels located above one another, for example. However, the printing press can also have only one common folding structure 11, arranged between the sections, or can have only one section and one associated folding structure. Also, the respective folding structure 11 can be embodied with only one level of formers. One or a plurality of folding apparatus 12 can be assigned to each folding structure 11.

Figure 2:
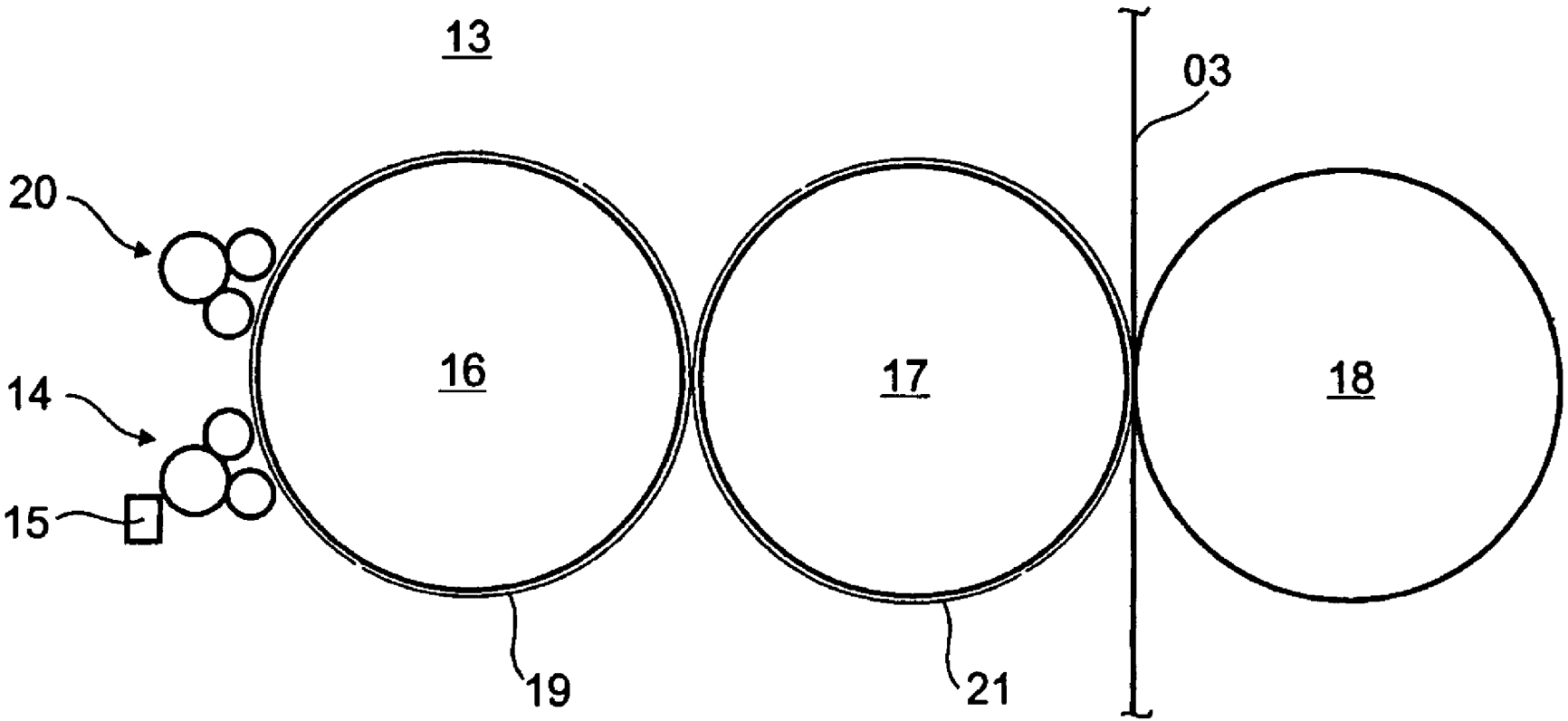

Each printing unit 02 has a plurality, in the preferred embodiment depicted in FIG. 1 four, printing groups 13, by operation of which, ink from an inking unit 14 can be applied to the web 03 by operation of at least one cylinder 16 embodied as a forme cylinder 16, as shown in FIG. 2. In the first embodiment of the printing unit 02 as a satellite printing unit 02, the printing group 13 is configured as an offset printing group 13 for wet offset printing and has, in addition to the inking unit 14, a dampening unit 20 and a further cylinder 17, embodied as transfer cylinder 17. Together with a cylinder 18 constituting a counter-pressure cylinder or thrust element, the transfer cylinder 17 forms a print position. In the example of FIG. 1, the counter-pressure cylinder 18 is embodied as a satellite cylinder 18 which, together with further transfer cylinders 17 of further printing groups 13, constitutes further print positions when in the print-on position. In an embodiment of the printing groups as a double printing group for rubber-against-rubber printing, the counter-pressure cylinder 18 could also be embodied as a transfer cylinder 18. If not required for their differentiation, identical parts are provided with the same reference symbols. However, a difference in their spatial position can exist and is disregarded as a rule when identical reference symbols are provided.

In an advantageous embodiment, the inking unit 14 shown in FIG. 2 has an ink duct 15 which is extending laterally over six printed pages. In a different embodiment, three ink ducts 15, each of which may be approximately two printed pages wide, are arranged side-by-side in the cylinder axial direction. In an advantageous embodiment, the dampening unit 20 is embodied as a spray dampening unit 20 with four rollers.

In a first embodiment, the forme cylinder 16 has a circumference between 850 and 1,000 mm, and in particular between 900 and 940 mm. For example, for receiving two vertical printed pages, for example two newspaper pages in broadsheet format, the circumference is designed with two dressings or covers 19, for example two flexible printing formes 19, which can be fixed in place, one behind the other, in the circumferential direction on the forme cylinder 16. The printing formes 19 can be fixed in place in the circumferential direction on the forme cylinder 16 and, in the configuration represented schematically in FIG. 3, can be individually exchanged in the form of individual printing plates 19, each of which is equipped with one printed page in the axial direction.

Figure 3:
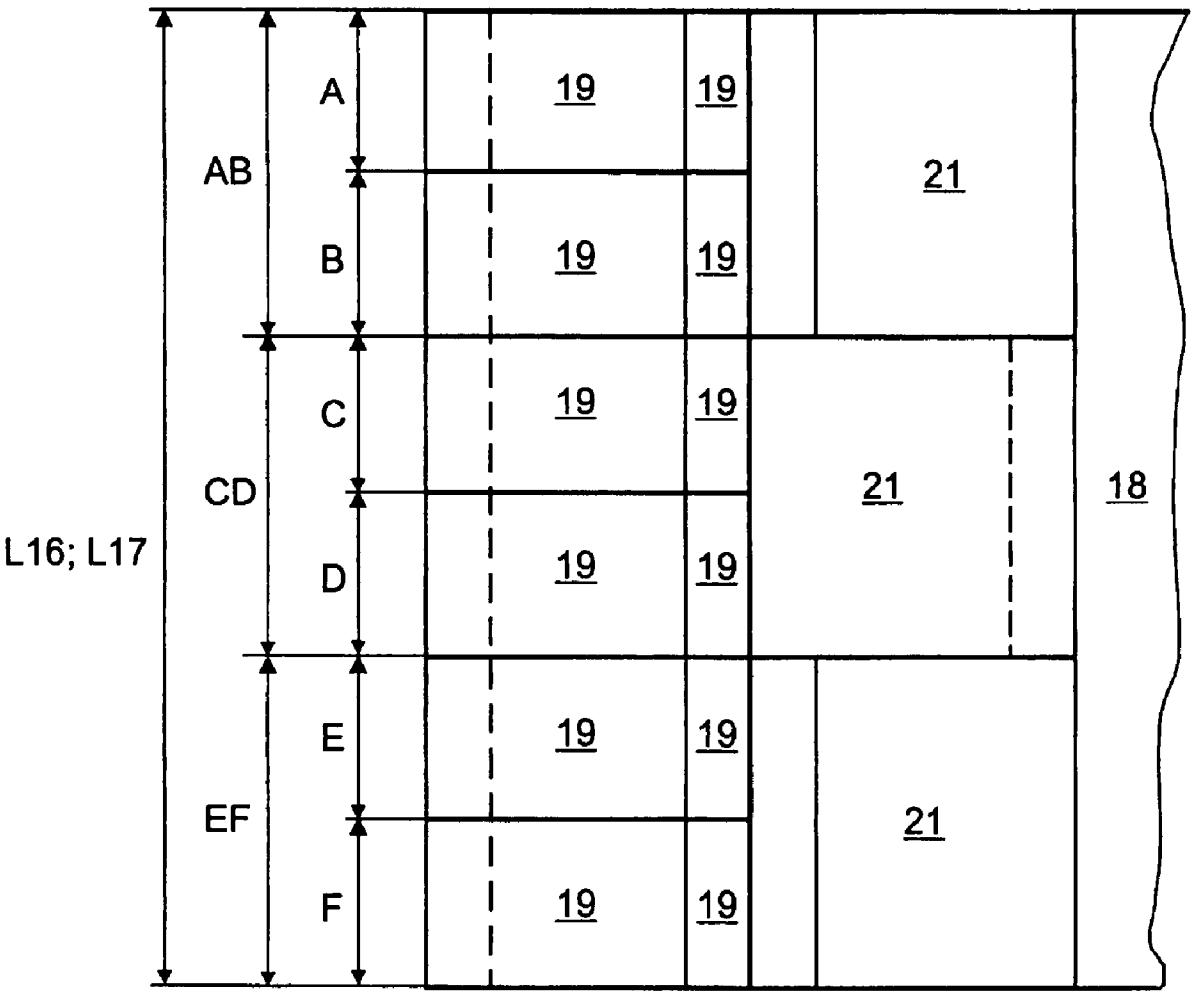

In the first embodiment, the length L16 of the usable barrel of the forme cylinder 16, as shown in FIG. 3, is 1,850 to 2,400 mm, and in particular is 1,900 to 2,300 mm, and is configured in the axial direction, for receiving, for example, at least six vertical printed pages which are arranged side-by-side, and in particular for receiving newspaper pages in broadsheet format, as seen in FIG. 3, at sections A to F. In this case, it depends, inter alia, on the type of the product to be made whether only one printed page, or a plurality of printed pages are arranged side-by-side in the axial direction on a printing plate 19. In an advantageous wider variation of the first embodiment, the length L16 of the usable barrel of the forme cylinder 16 lies between 2,000 and 2,400 mm.

In a second embodiment, the forme cylinder 16 has a circumference, for example, of between 980 and 1,300 mm, and in particular of between 1,000 and 1,200 mm. In this case, the length of the usable barrel is, for example, 1,950 to 2,400 mm, and in particular is between 2,000 and 2,400 mm. The covering corresponds to the above mentioned embodiment.

In the first embodiment, the transfer cylinder 17 also has a circumference of, for example, between 850 and 1,000 mm, and in particular of between 900 and 940 mm. The length L17 of the usable barrel of the transfer cylinder 17 in the first embodiment is, for example, 1,850 to 2,400 mm, and in particular is between 1,900 to 2,300 mm, and it is equipped, in the linear direction, with, for example, three dressings 21, for example rubber blankets 21, shown as sections AB to EF. They substantially extend in the circumferential direction over the entire circumference. Advantageously affecting the oscillating behavior of the printing group during operation, the rubber blankets 21 are arranged alternatingly offset in respect to each other, for example by 180°, as shown in FIG. 3. In the wider variation of the first embodiment, the length L17 of the usable barrel also lies between 2,000 and 2,400 mm.

In the second embodiment, the transfer cylinder 17 has a circumference, for example, between 980 and 1,300 mm, and in particular between 1,000 and 1,200 mm. The length L17 of the usable barrel here is, for example, 1,950 to 2,400 mm, and in particular from 2,000 to 2,400 mm. The covering with dressings 21 corresponds to that of the first embodiment.

In the first above mentioned embodiment, the diameters of the barrels of the cylinders 16, 17 lie, for example, between 270 to 320 mm, and in particular are approximately 285 to 300 mm in diameter. In the second above mentioned embodiment, the diameters of the barrels of the cylinders 16, 17 lie, for example, between approximately 310 to 410 mm, and in particular between 320 and approximately 380 mm. The ratio of the lengths of the usable barrels of the cylinders 16, 17 to their diameters should be 5.8 to 8.8, for example between 6.3 to 8.0, and in a wide embodiment, in particular between 6.5 to 8.0.

The width or length of the barrel is here understood to be that length L16, L17 of the usable barrel which is suited for receiving dressings, covers or blankets 19, 21. This barrel width also approximately corresponds to a maximally possible web width of a web 03 to be imprinted. In relation to the total length of the barrels of the cylinders 16, 17 it would be necessary here to add to this length L16, L17 of the usable barrel the width of possibly existing cylinder bearing rings, of possibly existing channels and of possibly existing shell surface areas which must be accessible, for example, for operating bracing and/or clamping devices.

In an advantageous embodiment, the satellite or counterpressure cylinder 18 also substantially has the above-mentioned dimensions and ratios of at least the associated transfer cylinder 17.

Figure 4:
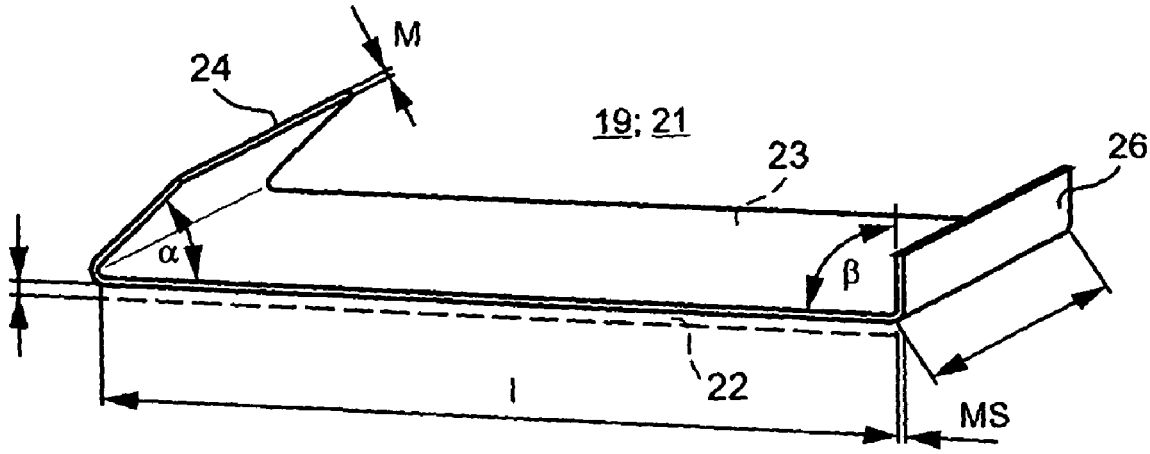

As schematically represented in FIG. 4, the dressings, covers or blankets 19, 21 are embodied as flexible plates, for example, wherein the dressing 21 embodied as a rubber blanket 21 is structured as a so-called metallic printing blanket 21, having an elastic and/or compressible layer 22, which is shown in dashed lines, and which is arranged on a support plate 23. Only the reference symbols in regard to the metallic printing blanket 21 are connected by dashed lines in FIG. 4. As a rule, a plate-shaped printing forme 19, or a support plate 23 for a rubber printing blanket, consists of a flexible, but otherwise dimensionally stable material, for example an aluminum alloy, and has two oppositely located ends 24, 26 to be fastened in or on the cylinder 16, 17, and of a material thickness MS of 0.2 mm to 0.4 mm, for example, and of preferably 0.3 mm, wherein, for being embodied as suspension legs 24, 26, these ends 24, 26 are beveled or angled along a bending line, in relation to the elongated length I of the dressing 19, 21, by an angle α, or β of between 40° and 140°, and preferably of between 45°, 90° or 135°, as seen in FIG. 4. A leading end 24 of dressing 19, 21 is beveled, for example, at an acute angle α or of 40° to 50°, and in particular of 45°, and a trailing end 26 is beveled at an angle β of 80° to 100°, and in particular of 90°. If only a single dressing 21 has been applied in the circumferential direction of the cylinder 16, 17, and in particular of the circumferential direction of the transfer cylinder 17, the length I of the dressing 21 nearly corresponds to the circumference of this transfer cylinder 17.

In principle, the beveled edges 24, 26 of the dressing 19, 21 can now be inserted into a slit-shaped opening, which extends axis-parallel, and in the longitudinal direction, on the circumference of the respective cylinder 16, 17. The ends 24, 26 of the dressing 19, 21 are maintained in place by their shape, by friction or by deformation, for example. However, the dressing ends 24, 26 can also be basically fixed in place by application of a spring force, by pressure devices, or by a centrifugal force which is effective during the press operation. In an advantageous embodiment, the slit-shaped openings for printing plates 19, arranged side-by-side in the axial direction on the forme cylinder 16, are each arranged in alignment, for example are each arranged in the form of a continuous slit-shaped opening, as will be described subsequently, while the openings for the rubber blankets 21, which are arranged side-by- side on the transfer cylinder 17, are not continuously offset, but instead are arranged in alternation with each other by 180° in the circumferential direction. In a perspective view, as shown in FIGS. 5*a* and *b* there is depicted an example of a preferred embodiment of the forme cylinder 16. Two channels 27 are provided in the forme cylinder 16. Both of these channels 27 extend continuously, in the axial direction of the forme cylinder 16, over at least the entire length of the six sections A to F on the barrel, as seen in FIG. 5*b*. These two channels 27 are arranged offset, in respect to each other, for example by 180°, in the circumferential direction of the forme cylinder 16. The two channels 27 are arranged underneath a shell surface 30 of forme cylinder 16, in the interior of the cylinder 16 and are embodied as circular bores, for example, and each have a narrow, slit-shaped opening 28 facing toward the shell surface 30 of the cylinder 16 and extending over the length of the six sections A to Fig., as seen in FIG. 5*a*. A slit width s16, in the circumferential direction of the opening 28 on the forme cylinder 16, is less than 5 mm, and preferably lies in the range of 1 mm to 3 mm, as shown in FIG. 5*c*.

The beveled edges 24, 26 of the printing forme 19 can now each be inserted into one of the openings 28, which are axis-parallel in the longitudinal direction on the circumference, and can be fixed in place, or at least the trailing end 26 can be fixed in place, by the use of a holding device 29, 31 which is arranged in the channel 27.

Here, the holding device 29, 31 has at least one clamping element 29 and a spring element 31, as seen in FIG. 5*c*. The trailing suspension leg 26, as shown in see FIG. 4, which is beveled at right angles and which is not represented in FIG. 5*c*, preferably comes into contact with a wall, which wall is substantially shaped in a complementary shape, to the bevel, of the opening 28, and the trailing suspension leg 26 is pressed against the complementarily-shaped wall by the clamping element 29 by operation of a force that is exerted by the spring element 31 on the clamping element 29. The suspension leg 24, as seen in FIG. 4, which is beveled at an acute angle and which is not represented here, preferably comes into contact with a wall, which is substantially shaped complementary to the bevel 24, of the opening 28, which forms a suspension edge or suspension protrusion, together with the shell surface, angled at an acute angle α' of 40° to 50°, and in particular of 45°. An actuating device 32 is provided for releasing the clamping of the trailing end 26 in the channel 27 which, when actuated, acts counter to the force exerted by the spring element 31 on the clamping element 29 and pivots the clamping element 29 away from the wall, or from the end 26.

In an advantageous embodiment, not only one clamping element 29 is arranged in each channel 27. Several clamping elements 29 are arranged axially side-by-side in the form of segments, each with at least one spring element 31, over the length of the sections A to Fig., and which are represented "pulled out of" the cylinder 16 in FIG. 5*a*. In the preferred embodiment, several, for example six, such clamping elements 29 in accordance with FIG. 5*c* are arranged for each section A to F, wherein a color congruence element 33 with a register block 35, as shown in FIG. 5*d*, is arranged centered between the clamping elements 29 of each section A to F, and in this case is arranged between the third and the fourth clamping element 29 of each section A to F. The register block 35, or the congruence pin 35, can be manually displaced and can be adjusted, in the axial direction, in a channel of the base 34. In a further development, which is not specifically represented, the register block 35 can also be axially movable by use of a respective actuation device, for example by the use of a motor-driven threaded spindle, which actuation device is axially conducted in a hollow space of the channel 27, or the color congruence element 33, which remains unoccupied.

In the embodiment represented in FIGS. 5*a-fd*, the actuating devices 32 are embodied in such a way that, when operated, the holding device, or devices 29, 31, i.e. all of the clamping elements 29, are simultaneously closed, or released, over the length of the sections A to F. Each actuating device 32, which is represented as being "pulled out of" the cylinder 16 in FIG. 5*a*, is embodied as a reversibly deformable hollow body 32, for example as a hose 32, which hollow body 32 extends at least over the length of the sections A to F, extends axially in the channel 27, and can be actuated by a pressure medium. In accordance with FIG. 5*c*, this hose is arranged, working together with clamping elements 29, in the channel 27 in such a way that, when it is actuated, it counteracts the spring elements 31 which self-lockingly close the holding device. Hose 32 is passed through the areas of color congruence elements 33, as seen in FIG. 5*d*.

Figure 6:
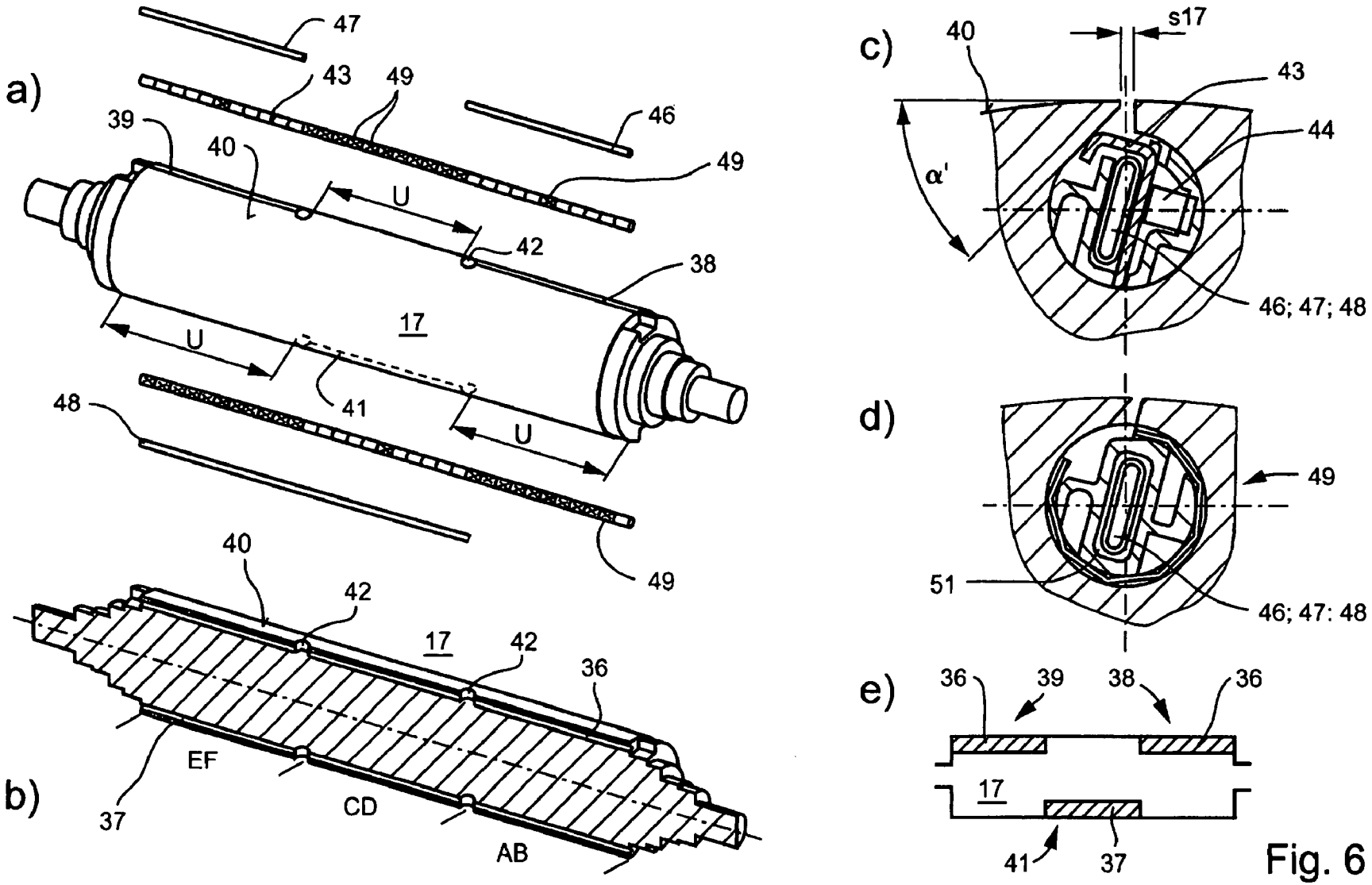

In a perspective view, shown in FIGS. 6*a* and *b* there is represented an example of an advantageous embodiment of the transfer cylinder 17. Two channels 36, 37 are provided in the cylinder 17. Both channels 36, 37 extend continuously in the axial direction of the cylinder 17 over at least the entire length of the six sections A to F, or sections AB, CD, EF, on the barrel, seen in FIG. 6*b*. Channels 36, 37 are arranged offset with respect to each other, for example by 180°, in the circumferential direction of the cylinder 17.

The two channels 36, 37, which are arranged underneath a shell surface 40, and thus in the interior of the cylinder 17, are embodied, for example, as circular bores, have a total, for example three, narrow, slit-shaped openings 38, 39, 41 facing toward the shell surface 40 of the cylinder 17, as shown in FIG. 6*a*, each of which openings 38, 39, 41 extends axially and at least over the length of a section AB, CD, or EF of the transfer cylinder 17. Two of the three openings 38, 39 are connected with the same channel 36 and are arranged aligned with each other in the axial direction, but are spaced apart from each other, on the shell surface 40. A section U without an opening, which extends the shape of the remaining shell surface 40, and which is uninterrupted in particular, lies axially between the two openings 38, 39. The two aligned openings 38, 39, which, for example, are connected with the same channel 36, are preferably the openings 38, 39 close to the cylinder end faces, wherein the third opening 41 extends axially at least over the center section CD of transfer cylinder 17 and is arranged offset by 180° with respect to the other openings 38, 39. A slit width s17 of each of the uncovered openings 38, 39, 41 on the transfer cylinder 17 is respectively less than 5 mm in the circumferential direction, and preferably lies in the range of 1 mm to 3 mm, as seen in FIG. 6*c*. It is possible, for production purposes, to provide radially extending bores 42 at respectively one of two ends of the slits 38, 39, 41 which, bores 42 in the operational state of the cylinder 17, can be or are closed by the use of a stopper, which is not specifically represented, as seen in FIG. 6*b*. The stopper has an exterior surface which extends the otherwise cylindrical contour of the cylinder 17 in the mounted state into the area of the bore 42. In a section perpendicular with respect to the axis of rotation, respectively only one of the openings 38, 39, 41, or an opening 38, 39, 42 shortened by the stoppers, is arranged one behind the other in the circumferential direction of the cylinder 17 in an advantageous embodiment. In this sectional view, the openings 38, 39, 41, or the opening 38, 39, 41 shortened by the stoppers, therefore do not intersect.

Now the beveled edges 24, 26 of the rubber blanket 21 can each be inserted into one of the openings 38, 39, 41, respectively and extending axis-parallel at the circumference, and can be, at least for the trailing end 26, fixed in place by respectively at least one holding device 43, 44 which is arranged in the channel 36, 37. Preferably the two ends 24, 26 of the same rubber blanket 21 are introduced through the same opening 38, 39, 41 into the same channel 36, 37.

Here, the holding device 43, 44 has at least one clamping element 43 and one spring element 44, as seen in FIG. 6*c*. The trailing suspension leg 26, as seen in FIG. 4, which is beveled at right angles and which is not represented in FIG. 4*c*, preferably comes into contact with a wall, which is substantially shaped complementary to the bevel, of the opening 38, 39, 41, and is pressed against that complementarily shaped wall by the clamping element 43 by a force exerted by the spring element 44 on the clamping element 43. The suspension leg 24, as seen in FIG. 4, which is beveled at an acute angle and which is also not represented in FIG. 4*c*, preferably comes into contact with a wall, which is substantially shaped complementary to the bevel, of the opening 38, 39, 41, and which forms a suspension edge or a suspension protrusion, together with the shell surface 40, at an acute angle $\alpha'$ of 40° to 50°, and in particular of 45°. An actuating mechanism 46, 47, 48 is provided for releasing the clamping force applied to the trailing end 26 in the channel 36, 37 which, when actuated, acts counter to the force exerted by the spring element 44 on the clamping element 43 and pivots the clamping element 43 away from the wall. In an advantageous manner, at least one actuating mechanism 46, 47, 48, which is represented "pulled out of" the cylinder 17 in FIG. 6*a*, is provided for each of the three openings 38, 39, 41 in the respectively assigned channel 36, 37.

In an advantageous embodiment, not only is one clamping element 43 arranged in each channel 36, 37, but several clamping elements 43 are arranged axially side-by-side in the form of individual segments, each with at least one spring element 44, over the length of the sections AB, CD, EF, which are represented "pulled out of" the cylinder 17 in FIG. 6*a*. In the preferred embodiment, several, for example ten, such clamping elements 43 in accordance with FIG. 6*c* are arranged for each section AB, CD, EF, and for each opening 38, 39, 41. In sections AB, CD, EF of the respective channel 36, 37, which do not have an opening facing toward the shell surface 40, at least one filler element 49, shown in FIG. 6*d* is arranged in the channel 36, 37 in place of the holding device 43, 44, or of the holding devices 43, 44. In the example, a plurality, for example eleven, of these filler elements 49 are arranged as individual segments in the respective section AB, CD, EF of the channel 36, 37 which has no opening. Respectively, one filler element 49, as seen in FIG. 6*d*, can also be arranged, centered between the holding devices 43, 44 of each section AB, CD, EF, i.e. in the area between the sections A and B, or E and F, here between the fifth and sixth clamping element 43. Each filler element 49 has a cross section substantially adapted from the cross section of the channel 36, 37, and at least one axially continuous opening 51, through which an operating mechanism for the actuating devices 46, 47, 48 can be passed.

In the embodiment represented in FIGS. 6*c* and 6*d*, the actuating device 46, 47, 48 is embodied in such a way that, when the holding device 43, 44 of a section AB, CD, EF is actuated, all of the clamping elements 43 of a section AB, CD, EF, are simultaneously closed or released. In FIG. 6*a* the actuating devices 46, 47, 48 are represented "drawn out of" the cylinder 17. In the front in the channel 36, with two openings 38, 39, one actuating device 46 or 47, respectively extends over at least the corresponding length of the section AB or EF. The actuating device 48, which is assigned to the center opening 41, also extends over at least the corresponding length of the section CD. However, if it is advantageous for the supply of an operating mechanism, as shown in FIG. 6*a*, it can also extend on at least one side as far as the front or end area of the cylinder 17. Each of the actuating devices 46, 47, 48 is embodied as a reversibly deformable hollow body 46, 47, 48, extending axially in the channel 36, 37, and which can be actuated by a pressure medium, for example as a hose 46, 47, 48.

In accordance with FIG. 6*c*, this hose 46, 47, 48 is arranged, working together with clamping elements 43, in the channel 36, 37 in such a way that, when actuated, it counteracts the spring elements 44 which self-lockingly close the holding device 43, 44. Through the areas of filler elements 49 to be bypassed, the hose is passed through these filler elements 49, or through their opening 51, as seen in FIG. 6*d*.

In a different embodiment of the channels 36, 37, these can be embodied so they do not continuously extend over the entire length. For example, respectively one channel 36, 37, if required, with an appropriate holding device, is provided in the area of each cylinder section AB, CD, EF, wherein the channel 37 of the center dressing 21 is offset by 180° in respect to the two outer ones. This is depicted, only schematically, in FIG. 6*e*.

In an embodiment which is particularly advantageous in connection with the printing units 02, or in connection with cylinders 16, 17 of a width of six pages, a device 52 for pushing a dressing 19, 21 against a cylinder 16, 17, and in particular for pushing a printing forme 19 against the forme cylinder 16 of at least one of the printing towers 01, is assigned to at least two cylinders 16, 17, in particular two forme cylinders 16. This device 52 is referred to as a pressing device 52 in what follows. For example, use of this pressing device 52 is advantageous if it is intended to perform a rapid, for example a flying plate change, in two corresponding printing groups 13. It is advantageous, in particular, for a rapid, dependable and exact product change if such a pressing device 52 is assigned to all of the forme cylinders 16 of a printing tower 01. An appropriate pressing device 52 in accordance with the present invention has one or several pressing elements 53, 54, for example strips, plungers or roller elements 53, 54, which can be selectively placed against one or against several dressings 19, 21. This makes possible a controlled and guided draw-on, or tensioning or a controlled releasing or removing of the dressing 19, 21. It is also possible, by use of this pressing device 52, to move one end 24, 26 of the dressing 19, 21 into the corresponding channel 27, 36, 37, or into the opening 28, 38, 39, 41, or to keep down a released end 24, 26, or the partially released dressing 19, 21 in a desired position. The pressing device 52 extends along the cylinder 16, 17 at least in the entire area of the sections A to F, i.e. in the area of the barrel of the cylinder 16, 17 which is effective for printing.

Figure 5:
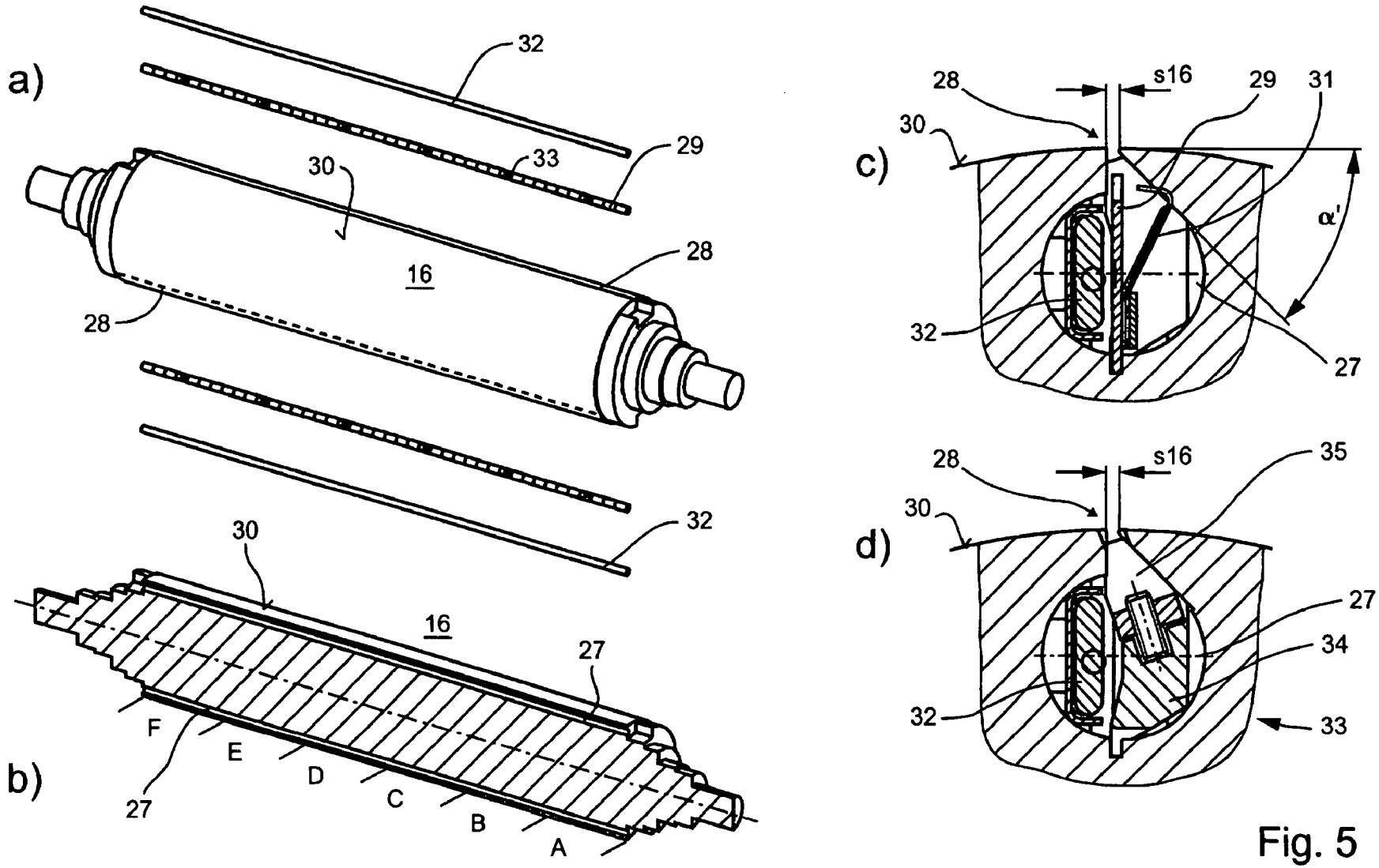
FIG. 5, a forme cylinder, a: in a perspective representation, b: in longitudinal section, c: with a holding element, and d: with a holding element with a register arrangement, in FIG. 6, a transfer cylinder, a: in a perspective representation, b: in longitudinal section, c: with a holding element, d: with a filler element, e: a schematic longitudinal section, in FIG. 7, a device for pressing a dressing against a cylinder, in FIG. 8, a first preferred embodiment of a drive mechanism of a nine-cylinder printing unit, in FIG. 9, a second preferred embodiment of a drive mechanism of a nine-cylinder printing unit, in FIG. 10, a third preferred embodiment of a drive mechanism of a nine-cylinder printing unit, in FIG. 11, an embodiment of the preferred embodiment in accordance with FIG. 8, in FIG. 12, an outline of a superstructure, in FIG. 13, a first preferred embodiment of a short register device, in FIG. 14, a second preferred embodiment of a short register device, in FIG. 15, an example of a web turning assembly, in FIG. 16, a front view of a harp, with a turned web, in accordance with FIG. 15, in FIG. 17, a folding structure of a web-fed rotary printing press in accordance with the present invention, in FIG. 18, a side elevation view of the folding structure and with web guidance, and in FIG. 19, a front elevation view of the folding structure of the present invention, with web guidance.
Figure 7:
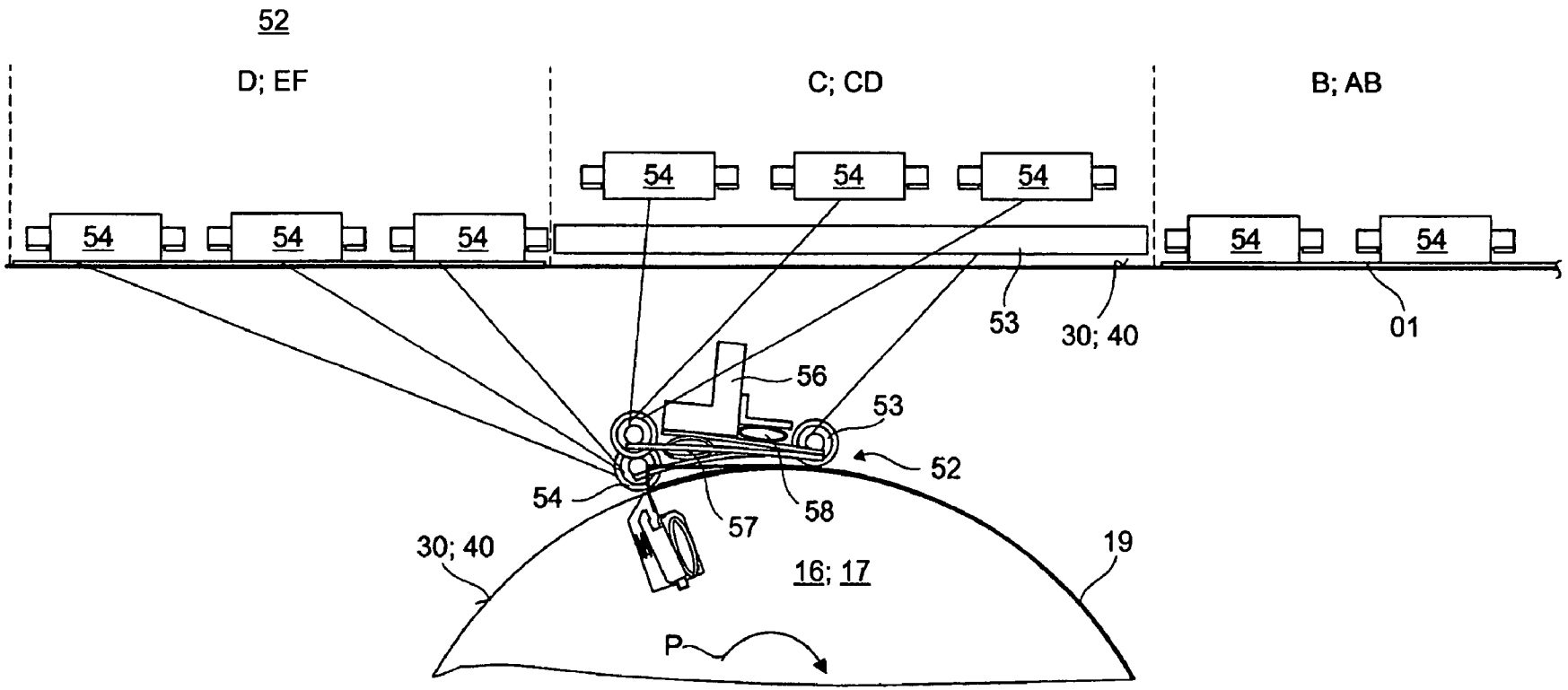

The embodiment of the pressing device 52 depicted in FIG. 7 is particularly advantageous in connection with the embodiment of the common actuating device 32 extending over all of the sections A to Fig., as described in FIG. 5. In this configuration, the draw-on, change and/or removal, individually or in groups, is also possible for six printing formes 19 that are arranged side-by-side on the forme cylinder 16, without an increased outlay of actuating devices or of operating supply needing to provided within the forme cylinder 16. Production, assembly and maintenance is also considerably simplified by this.

For each section A to F, in the case of six dressings 19 arranged side-by-side, or for each section AB, CD, EF, in case of three dressings 21 arranged side-by-side, the pressing device 52 has at least one first pressing element 53, for example one first pressing roller element 53. In an advantageous embodiment, in accordance with FIG. 7, pressing device 52 also has a second pressing element 54, for example a second pressing roller element 54 that is spaced apart from this first roller element 53 in the circumferential direction of the cylinder 16, 17, for each section A to F, or for each section AB, CD, EF. In connection with the forme cylinder 16, only the center sections B, C and D, as well as the roller elements 53, 54 assigned to these sections B, C and D, are represented in FIG. 7. A pressing device 52 including a first pressing roller element 53, or a group of first pressing roller elements 53 arranged side-by-side in the axial direction, as well as, for example, a second pressing roller element 54, or a group of second pressing roller elements 54 arranged side-by-side in the axial direction, is arranged for each section A to F, or AB to EF. In the example shown in FIG. 7, a first roller element 53 and a group of three second roller elements 54 for each section A to F, or AB to EF is represented. In view of the danger of possible tilting, and of possibly wrong axial orientation, the arrangement of groups of at least two roller elements 53, 54, which can be moved independently of each other, is advantageous. A single roller element 53, 54 for a section A to F, or for sections AB to EF is embodied, for example, not as a roller 53, 54 extending in the longitudinal direction over almost the length of the sections A to F, or AB to EF, but as a roller element 53, 54 of a group only as a roller 53, 54 of, for example, at most a fraction of the length of the section A to F, or AB to EF.

The roller elements 53, 54, which are arranged axially side-by-side, as well as the roller elements 53, 54 which are arranged one behind the other in the circumferential direction, if both roller elements 53, 54 are provided, are, in principle, arranged, to be movable independently of each other, for example, on a cross arm 56, or on several cross arms 56. The sole first roller element 53, or the group of first roller elements 53 of each section A to F, or AB to EF, as well as the sole second roller element 54, or the group of second roller elements 54, if provided, of each section A to F, or AB to EF, can be actuated independently of each other by their respective own actuating devices 57, 58. These actuating devices 57, 88 are embodied as reversibly deformable hollow bodies 57, 58 which can be actuated by a pressure medium, and in particular are embodied as hoses 57, 58. However, it is also possible to provide differently configured, such as electrically or magnetically actuable actuating devices. For stretching a dressing 16, 17 on one of the sections A to F, or AB to EF, the leading end 24 of the dressing, which leading end of the dressing 16, 17 is beveled at an acute angle, is inserted into the appropriate opening 28, 38, 39, 41. The first roller element, or elements assigned to this section A to F, or AB to EF, as well as, if provided, the second roller element, or elements assigned to this section A to F, or AB to EF, are placed against the cylinder 16, 17, or the against already suspended dressing 19, 21 to be drawn on. If one or if several dressings 19, 21 have already been arranged on the cylinder 16, 17 and are to remain there, the first and/or the second roller elements 53, 54 assigned to this section A to F, or AB to EF, are also placed against the respective dressing 19, 21. If first and second roller elements 53, 54 are provided, in the course of the cylinder 16, 17 with the roller elements 53, 54 rolling off against each other, the second roller element 54 pushes the trailing beveled end 26 of the dressing 19, 21 into the opening 28, 38, 39, 41 when rolling across it. If only first roller elements 53 are provided, these perform the inserting pressure. In the course of this procedure, the roller elements 53, 54 remain stationary, while the cylinder 16, 17 is rotated in a production direction P, as seen in FIG. 7. The holding elements for the sections A to F, or AB to EF, for example the one or the several clamping elements, change into their or its holding or clamping position; i.e. are closed. After the holding elements has changed from its, or their release position into its, or their holding position, all of the roller elements 53, 54 of the affected section A to F, or AB to EF, or their dressings, are pulled back.

When releasing a dressing 19, 21, it is necessary to ascertain whether one or several dressings 19, 21 should remain on the cylinder 16, 17. In this case, initially at least one of the roller elements 53, 54, which is assigned to the remaining dressing 19, 21, should be placed or is placed against this remaining dressing in the area of its trailing end 26, or close to the opening 28, 38, 39, 41. The roller element 53, 54 assigned to the dressing 19, 21 to be released can remain in place or is pulled back. The holding element for the sections A to F, or AB to EF is opened. The trailing end 26 of the dressing 19, 21 to be released will be released or removed from the channel 27, 36, 37 by its inherent tension, while the dressings 19, 21 which are to remain are held down by the roller elements 53, 54. The holding element is then closed again. If the pressing device 52 has first and second roller elements 53, 54 respectively, the dressings 19, 21 which are to remain in place are advantageously held down by at least the second roller elements 54. In connection with the dressing 19, 21 to be removed, at least the second roller element 54 is initially pulled back, so that the trailing end 26 can leave the channel 27, 36, 37, and the first roller element 53 is placed against it, so that the already partially released dressing 19, 21 is still guided and maintained on the cylinder 16, 17.

Thereafter, the cylinder 16, 17 can be rotated, preferably opposite to the production direction P, until the leading end 24 can be removed from the channel 27, 36, 37 and the dressing 19, 21 can be removed. If, in the course of unclamping the dressing 19, 21, no remaining dressings 19, 21 need to be considered, the roller elements 53, 54 relating to the dressing 19, 21 pertaining to the sections A to F, or AB to EF can, in principle, assume any arbitrary operating position during the procedure, and are preferably pulled away.

It is thus possible to fix dressings 19, 21, placed on the shell surface 30, 40 of the cylinder 16, 17, in place, as needed, by respectively at least one pressing element 53, 54, while an end 24, 26 of a dressing 19, 21, or several dressings 19, 21, is, or are released, i.e. is or are not pressed on.

Figure 8:
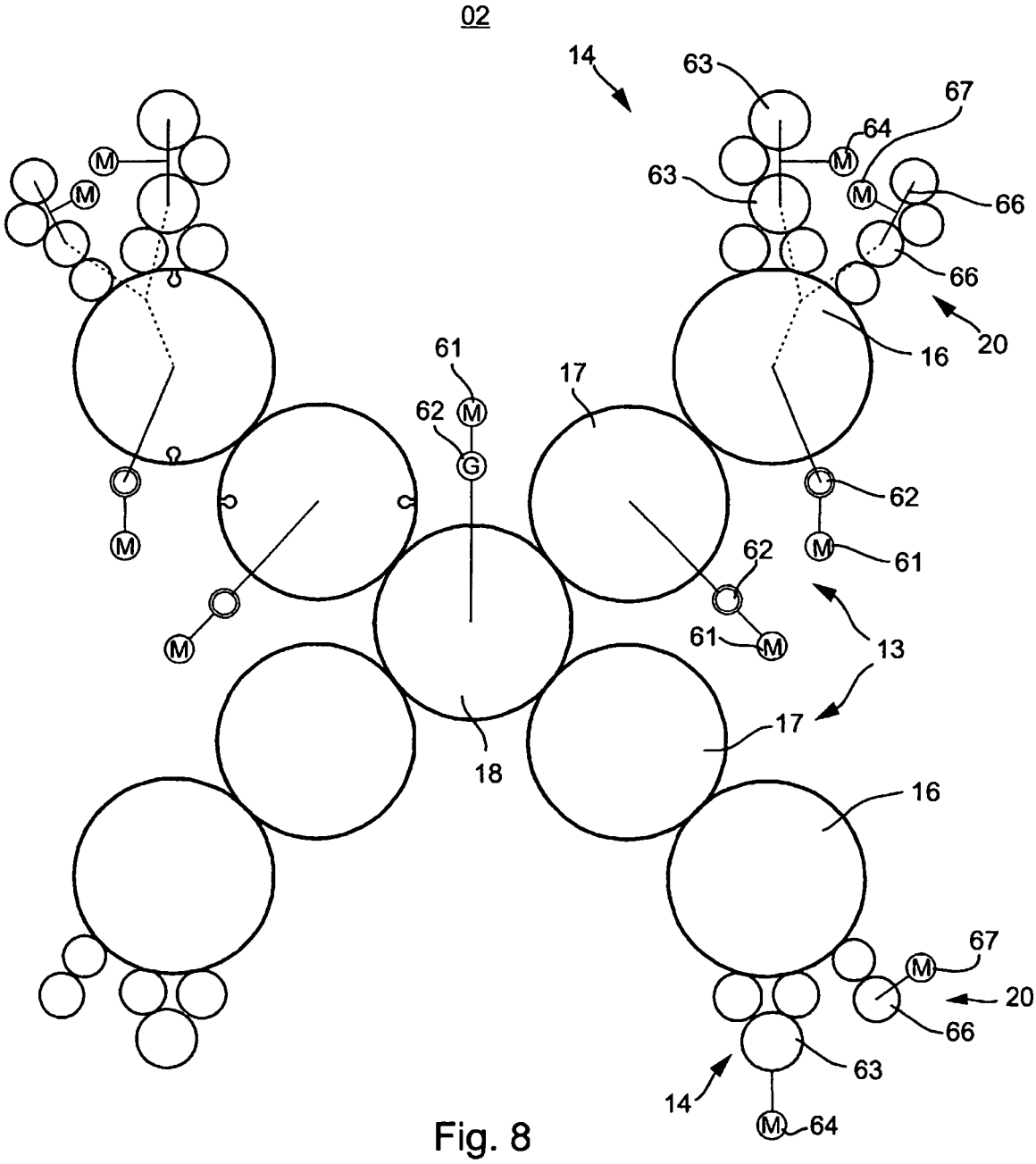
Figure 9:
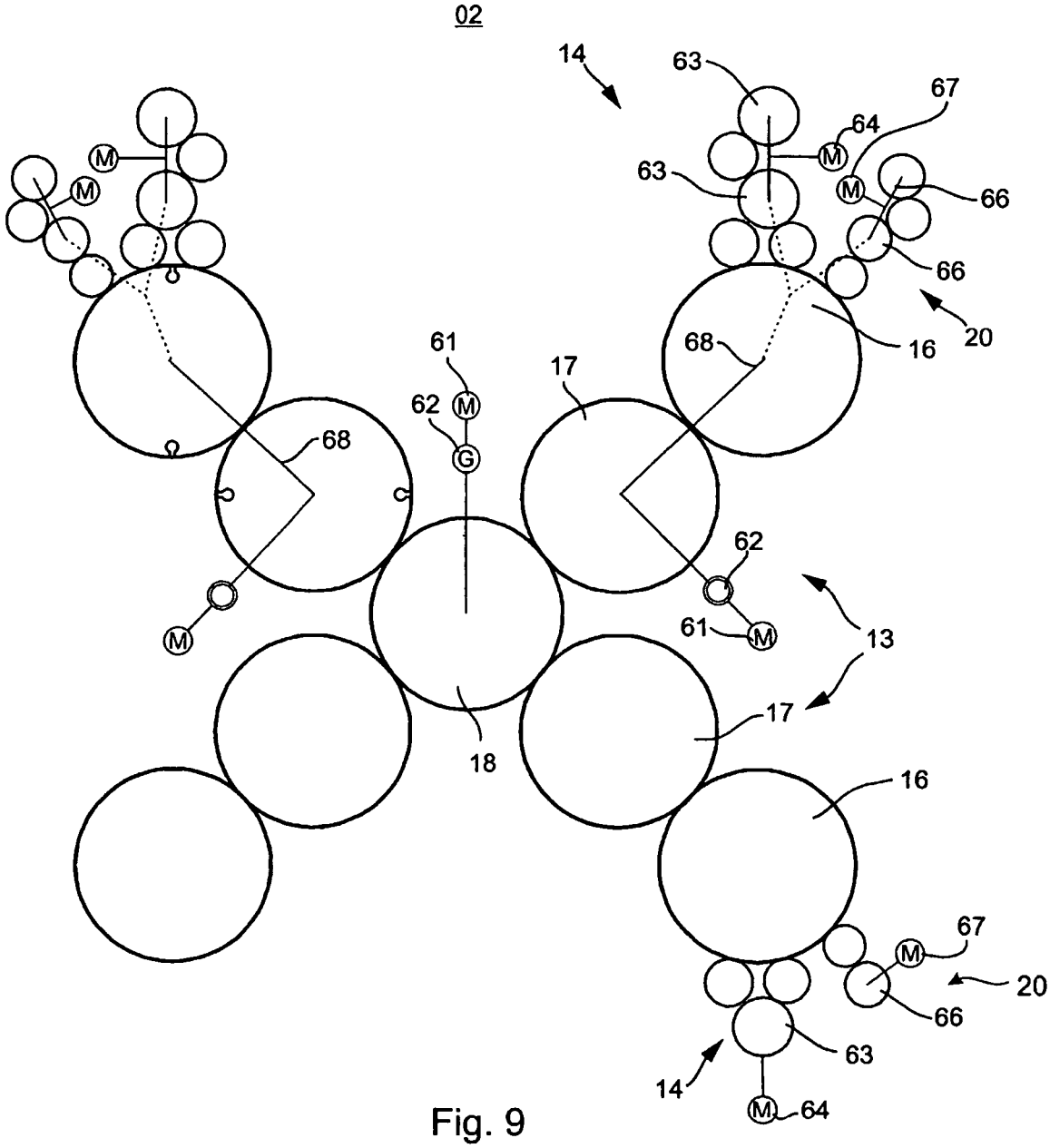
Figure 10:
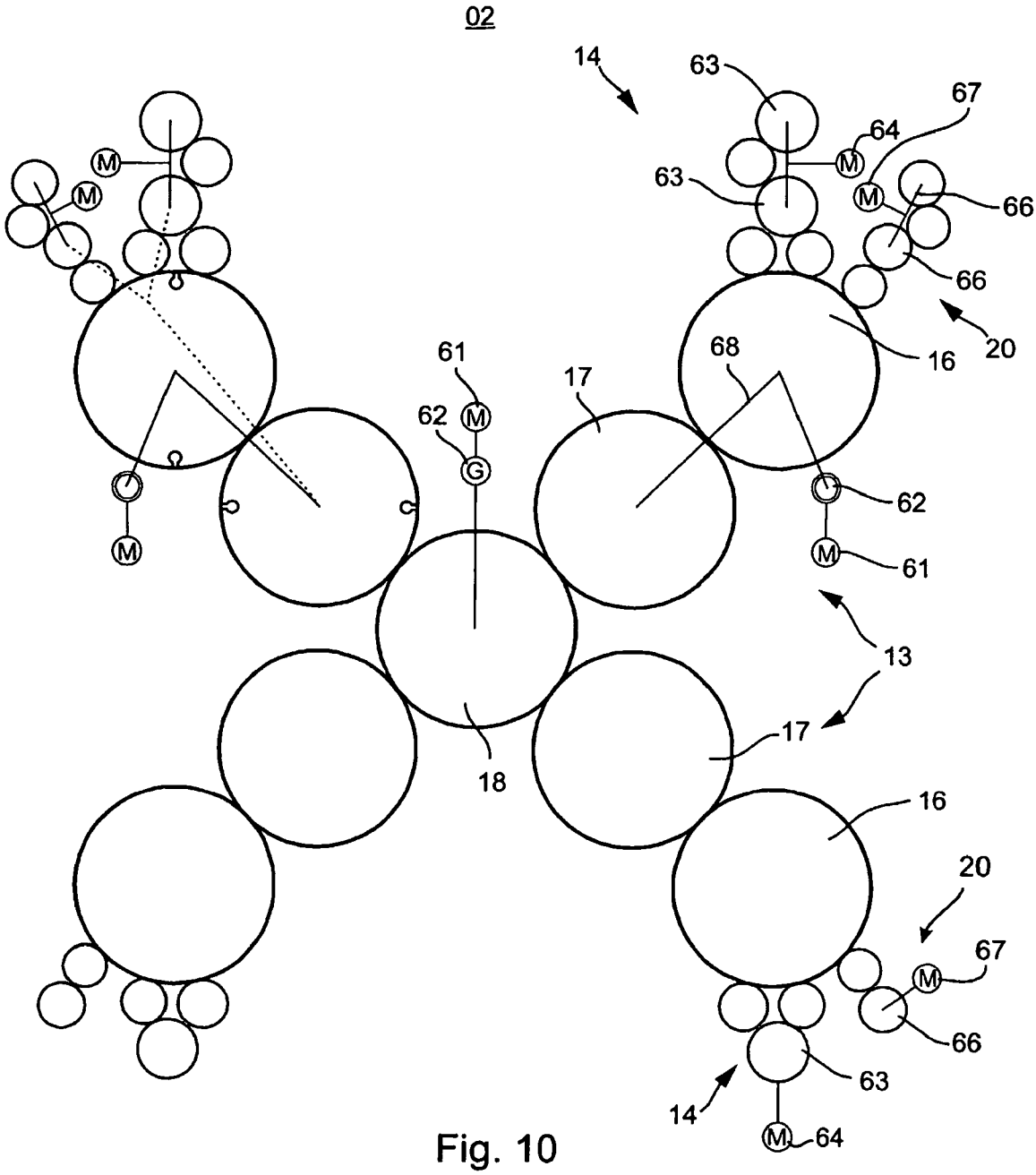

In an advantageous embodiment, cylinders 16, 17, 18 of the printing unit 02 are driven in such a way that the printing groups 13 of the printing unit 02 can each be rotatably driven by a drive motor 61, as seen in FIG. 8, which is independent of the remaining printing units 13. In the case of the satellite printing unit 02, the satellite cylinder or cylinders can also be rotatably driven by a drive motor 61 mechanically independent of the associated printing groups 13. Preferably, the drive motors 61 are embodied as electric motors which are regulated as to their angular position, for example as asynchronous, synchronous or d.c motors. In an advantageous further development, at least one gear 62, in particular at least one reduction gear 62, such as a pinion, an attached or a planetary gear, for example, is arranged between the drive motor 61 and the cylinder 16, 17, 18, or the pair of cylinders 16, 17, 18, to be driven. The individual drive mechanisms contribute to great flexibility, as well as to the avoidance of oscillations in the mechanical drive system, and therefore also contribute to a high quality of the product. In FIGS. 8 to 10, only the components shown on the right side of the figures have respective reference symbols, since the left side corresponds to the right in a mirror-reversed way. Alternative configurations of possibly provided inking or dampening systems 14, 20 are suggested for the respective upper and lower printing groups, which should be alternatively applied to each other.

All nine cylinders 16, 17, 18 in FIG. 8 each have their own drive motors 61, which drive their respective cylinder 16, 17, 18, for example via a gear 62. The inking system 14, which is represented at the top of FIG. 8 has, in addition to further, not specifically identified rollers, two distribution cylinders 63, which can be rotatably driven together by the operation of their own motors 64. For generating an axial stroke, the two distribution cylinders 63 can be axially moved and driven by a drive mechanism, which is not specifically represented. The inking system 14 represented at the bottom of FIGS. 8-10 has only one distribution cylinder 63. The dampening system 20 represented at the top of FIGS. 8-10 has, in addition to further, not specifically identified rollers, two distribution cylinders 66, which can be rotatably driven together by operation of their own motors 67. For generating an axial stroke, the two distribution cylinders 66 can be axially moved and driven by a drive mechanism, which is not specifically represented. The dampening system 20 represented at the bottom of FIGS. 8-10 has only one distribution cylinder 66. In a variation, which is indicated by dotted lines in the upper printing groups 13, the inking and dampening system 14, 20 is rotatably driven not by its own drive motor 64, 67, but from a cylinder 16, 17, 18, in particular from the forme cylinder 16, via a mechanical coupling, for example via gear wheels and/or belts.

In contrast to FIG. 8, the two cylinders 16, 17 of each printing group 13 are driven by a common drive motor 61 through the transfer cylinder 17 in the embodiment in accordance with FIG. 9. Driving can take place axially, for example via a gear 62, or via a pinion driving a drive wheel of the transfer cylinder 17. It is possible to transfer the power from the drive wheel of the transfer cylinder 17 to the drive wheel of the forme cylinder 16. The drive connection 68, represented as a connecting line, can take place in the form of a gear wheel connection or via belts, and is embodied so as to be encapsulated, in a further development. Regarding the driving of the inking system and possibly also the driving of the dampening system 14, 20, via their own drive motors 64, 67 or via a cylinder 16, 17, 18, what was discussed in connection with FIG. 8 can basically also be applied to FIG. 9.

In contrast to FIG. 9, the two cylinders 16, 17 of each printing group 13 are driven by a common drive motor 61, but through the forme cylinder 16 in the embodiment of the present invention in accordance with FIG. 10. Driving can again take place axially, for example via a gear 62, or via a pinion driving a drive wheel of the forme cylinder 16. It is possible to transfer the power from the drive wheel of the forme cylinder 16 to the drive wheel of the transfer cylinder 17. The drive connection 68 can be embodied as explained in accordance with FIG. 9. Regarding the driving of the inking system and possibly of the dampening system 14, 20 via their own drive motors 64, 67 or a cylinder 16, 17, 18, what was discussed in connection with FIG. 8 can again be basically also applied to FIG. 10.

Figure 11:
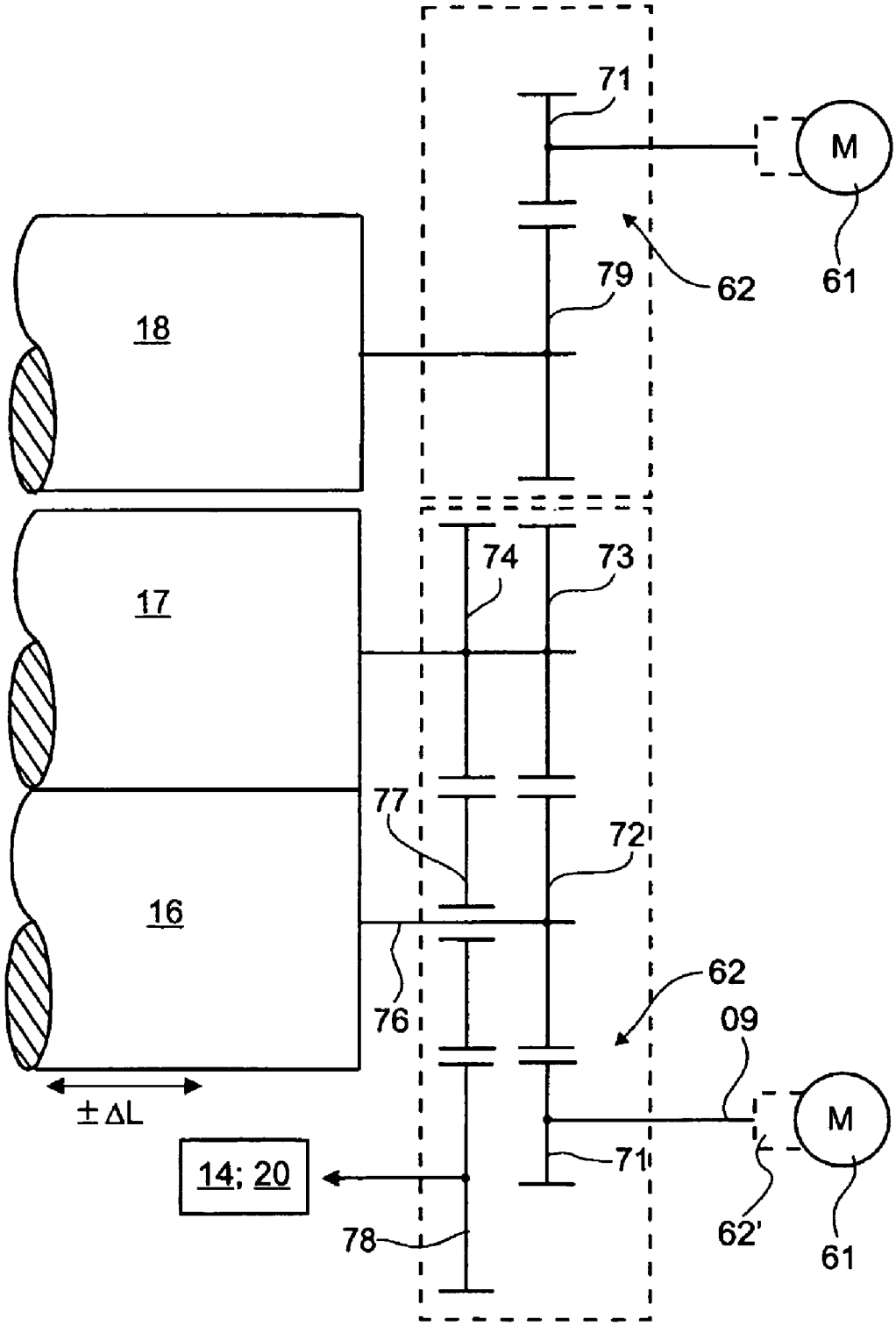

In contrast to the embodiment indicated by dotted lines in FIGS. 8 or 9 without the individual rotatory driving of the inking and/or of the dampening system 14, 20, it is however advantageous, in a further development, to transfer power from the transfer cylinder 17 to the inking and/or to the dampening system 14, 20. It is thus possible to achieve an unequivocal moment flow and to possibly prevent otherwise occurring tooth profile changes. An embodiment of such a drive train is schematically represented in FIG. 11.

The drive motor 61 drives a drive wheel 72, via a pinion 71, and a drive wheel 73 which is torsionally rigidly connected with the transfer cylinder 17. The drive wheel 73 is either embodied wider than drive wheel 72, or a second drive wheel 74 is connected with the transfer cylinder 17. The widened or additional drive wheel 73, 74 drives a drive wheel 78 of the inking and/or dampening system 14, 20 via a drive wheel 77, which drive wheel 77 is rotatably arranged on a journal 76 of the forme cylinder 16. The drive wheels 72, 73, 74, 77, 78 are preferably embodied as gear wheels. For the case wherein the forme cylinder 16 is embodied to change its location by, for example, ±Delta L, for adjusting its axial position, at least the pinion gear 71, as well as the drive wheels 72 to 74 are embodied with spur gear toothing. An encapsulated attached gear 62', which is indicated by dashed lines in FIG. 11, can be additionally arranged between the drive motor 61 and the gear train 62 consisting of the pinion 71 and drive wheel 72. Alternatively, driving of the forme cylinder 16 can also take place axially by the pinion 76 wherein, if required, an axial movement of the forme cylinder 16 takes place via a coupling which is not specifically represented, and which absorbs an axial relative movement between the forme cylinder 16 and the drive motor 61. In this representation, the satellite or counter-pressure cylinder 18 is also driven via a pinion 71 from a drive wheel 79, in particular a gear wheel 79, assigned to it. In an advantageous embodiment, each drive train, that is driven by an independent drive motor 61, is individually encapsulated, possibly in even smaller units, as represented in dashed lines in FIG. 11.

The above-described embodiments of the printing unit 02, or of the printing groups 13, or of their cylinders 16, 17, 18, or of the drive mechanism, allow low-oscillation, exactly color congruent printing of high quality with a small technical and spatial outlay, in regard to the attainable product size.

Figure 12:
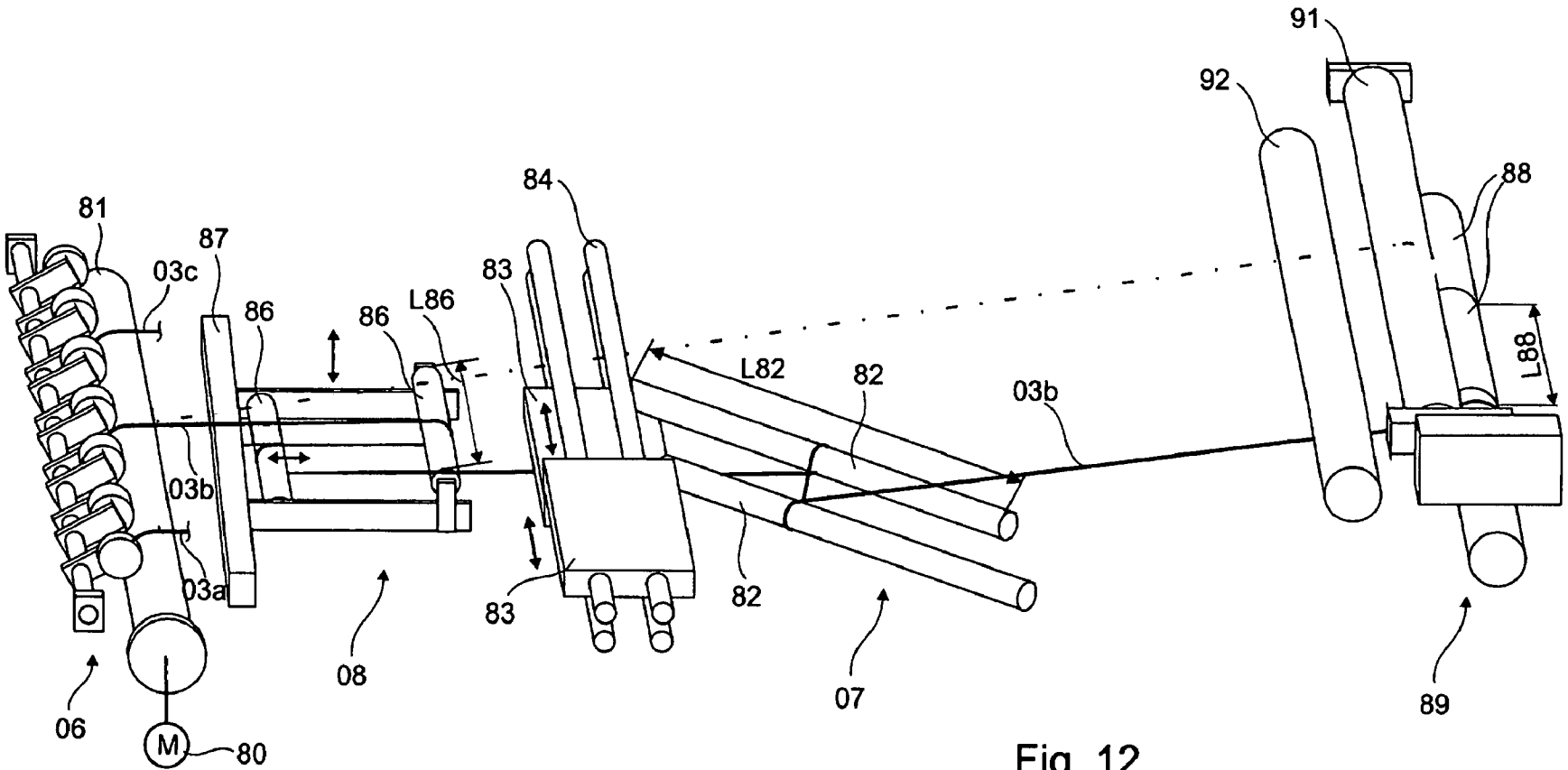

After the web 03 of, for example, a width of six printed pages has been imprinted, it runs into the area of the superstructure 04, as shown in FIG. 1, possibly via guide elements and/or traction rollers, which are not further identified, and is guided through the longitudinal cutting arrangement 06, for example. The cutting arrangement 06 has, for example, a traction roller 81 driven by its own drive motor 80, for example, and with which traction roller 81, suitable pressing rollers can work together for preventing slippage, all as depicted in FIG. 12. The longitudinal cutting arrangement 06 and the traction roller 81 can also be embodied separately wherein, however, another roller preferably works, together with the longitudinal cutting arrangement 06, as a counter-roller. The web 03 is longitudinally cut in this longitudinal cutting arrangement 06, into several, for example into three webs 03*a*, 03*b*, 03*c* of partial width, and which are called partial webs 03*a*, 03*b*, 03*c* for short. These partial webs 03*a*, 03*b*, and 03*c* are symbolized by center lines, with the lines 03*a*, 03*b* only being suggested. These partial webs 03, 03*b*, 03*c* are conducted to subsequent guide elements, for example to rollers of register arrangements 08, to turning bars of turning devices 07, to lead rollers for the entry into the former, or to traction rollers. In order to achieve a low oscillation web conveyance in regard to the web tension, individual, several, or all of the guide elements which are non-driven or which are driven only by friction with the web 03*a*, 03*b*, 03*c*, and which are intended for guiding the web 03*a*, 03*b*, 03*c*, can be embodied with a reduced length. In this way, it is possible to considerably reduce, beside the length, the great size of the guide elements otherwise required for presses of a width of six printed pages, and along with this, to reduce their inertia. The otherwise existing danger of oscillations in the web tension, which oscillations are existing, in particular, in connection with speed changes, is effectively reduced, which, in turn, affects the ability to maintain color congruence, and therefore the quality of the printing. The following remarks regarding guide elements of reduced length, ability for lateral changes, as well as the assignment of a register roller to another guide element, can be applied to the most various printing presses, but are of particular advantage in connection with wide, for example six plate-wide presses.

A first preferred embodiment of at least a portion of the superstructure 04 is represented in FIG. 12 in a perspective, oblique view. By way of example, the partial web 03*b* is represented in FIG. 12 as a partial web 03*b* turned from the center in an outward direction. A second one of the partial webs 03*a*, 03*c* could be turned, for example by the use of a second such turning device 07, also into another alignment. A second turning device, which is not specifically depicted, can be located, for example, above or below the first turning device 07.

As is customary, the turning device 07 has two parallel or crossed turning bars 82 as the guide element 82, which two turning bars 82 form an angle of approximately 45°, or of approximately 135° with the conveying direction of the incoming partial web 03*a*, 03*b*, 03*c*, and by the use of which turning bars 82 an incoming web 03*a*, 03*b*, 03*c* can be laterally offset or cambered. Advantageously, the turning bars 82 have a length L82, whose projection on the transverse extension of the incoming partial web 03*a*, 03*b*, 03*c* is slightly greater, for example is 0% to 20% greater, than the width of the incoming partial web 03*a*, 03*b*, 03*c*, i.e. the turning bar length L82 is approximately 1.4 to 1.7 times that of the partial web width. The length L82 has been selected to be at least such, that its projection is less than or equal to twice the width of a partial web 03*a*, 03*b*, 03*c* of a width of two pages, i.e. the length L82 is at most 2.8 times the partial web width. In an advantageous further development, the turning bars 82 are each separately seated on individual supports 83, the location of which supports 83 can be changed transversely to the direction of the incoming partial web 03*a*, 03*b*, 03*c* on at least one guide element 84. The now "short" turning bars 82 can now be brought from the desired web guidance into the required position in accordance with the respective requirements. Possibly both turning bars 82 can be seated on such a support 83.

Offset, turned, transferred and/or cambered partial webs 03*a*, 03*b*, 03*c* as a rule undergo an offset in the running direction in comparison with other partial webs 03*a*, 03*b*, 03*c*, and their linear register is therefore corrected by the use of a register arrangement 08. The register arrangement 08 has as seen in FIG. 12, at least one roller 86 as a guide element 86, which at least one roller 86 can be moved parallel with the running direction. In an advantageous manner, the guide element roller 86, or several rollers 86, of the register arrangement 08 have a length L86, which is slightly greater, for example between 0% to 20% greater, than the width of the incoming partial web 03*a*, 03*b*, 03*c*. The length L86 is at least less than or equal to twice the width of a partial web 03*a*, 03*b*, 03*c* of a width of two pages. In an advantageous further development, the register arrangement 08 is seated, in a displaceable manner, transversely to the direction of the incoming partial web 03*a*, 03*b*, 03*c* on at least one guide element 87. The now narrow register arrangement 08, or its short rollers 86, can now be brought from the desired web guidance into the required position in accordance with the respective requirements.

Besides being cut, turned and possibly registered, the partial web 03*a*, 03*b*, 03*c* is now conducted in the superstructure 04, possibly by the use of further, non-driven guide elements, such as guide rollers, which are not specifically represented, until it finally is conducted to a lead or a harp roller 88 of the so-called harp 09, which is shown in FIG. 1, and which is arranged upstream of the folding structure 11. For straight-running webs 03, or for partial webs 03*a*, 03*b*, 03*c*, a registration roller 91, extending over the full web width b03 and displaceable in the conveying direction, as well as a rerouting roller 92, are, for example, arranged in the superstructure 04 upstream of the harp roller 89.

Figure 13:
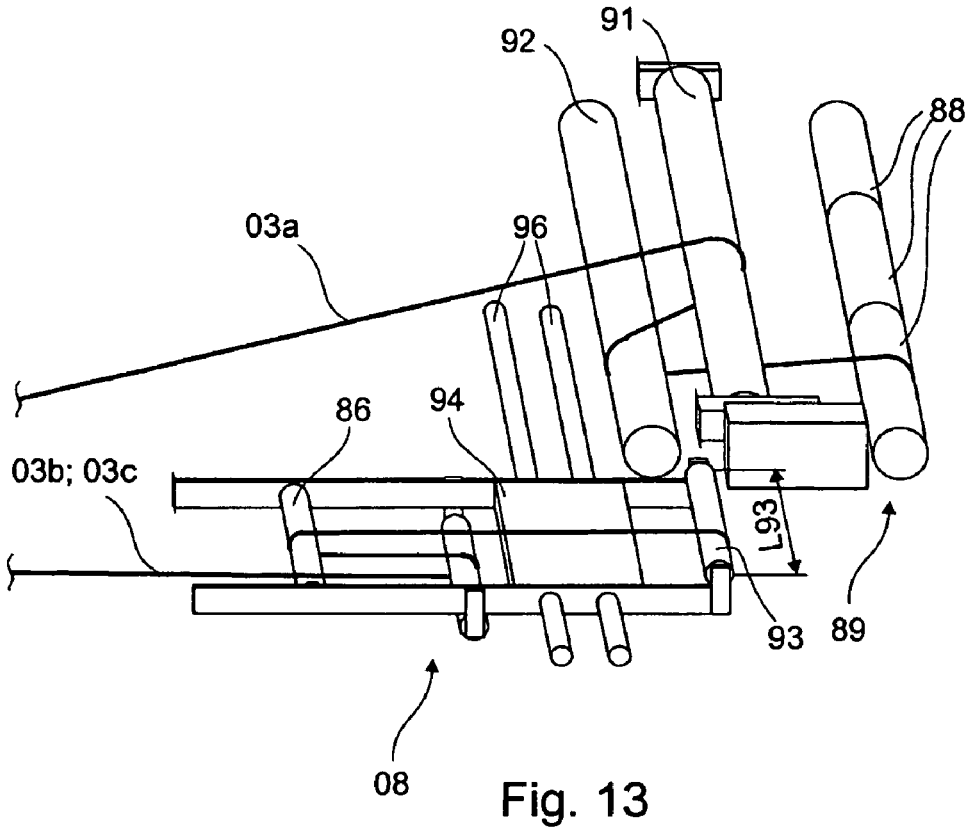

In an advantageous embodiment, again as seen in FIG. 12, a length L88 of a guide roller and/or of a harp roller 88, 93 is slightly greater, for example is 0% to 20% greater, than the width of the incoming partial web 03*a*, 03*b*, 03*c*. The length L88 shown in FIG. 12, or L93, shown in FIG. 13 is at least less than or equal to twice the width of a partial web 03*a*, 03*b*, 03*c* of a width of two pages. In the preferred embodiment, in accordance with FIG. 12, the "short" harp roller 88 is realized as a section 88 of a harp roller 89 which, in this embodiment, is divided, but which extends as a whole over a web 03 of a width of six printed pages. In this case, the several sections 88 of the harp roller 89 are rotatably seated independently of each other.

However, instead, of or in addition to a section 88, the "short" harp roller 88, 93 can also be embodied as a separate harp roller 93 arranged, on a frame, as represented in FIG. 13. The latter can then be arranged either fixed on the frame, or can be displaceable transversely to the direction of the incoming partial web 03*a*, 03*b*, 03*c* on a support 94, which support 94 is, in turn, mounted on a guide element 96.

Since the offset, in the course of turning, offsetting, cambering, or the like, only effects this partial web 03*a*, 03*b*, 03*c* and is tied to its specific web guidance, it is possible, in an advantageous embodiment, to assign the required register arrangement 08 to at least one of the guide elements determining the course of the partial web 03*a*, 03*b*, 03*c*, such as, for example, the turning device 07, or a turning bar 82, or the harp 09, or a "short" harp roller 93.

In FIG. 13, the "short" register arrangement 08 is assigned, for example, to the "short" harp roller 93 and can be displaced, together with the latter, on the guide element 96 transversely to the direction of the incoming partial web 03*b*, 03*c*.

Figure 14:
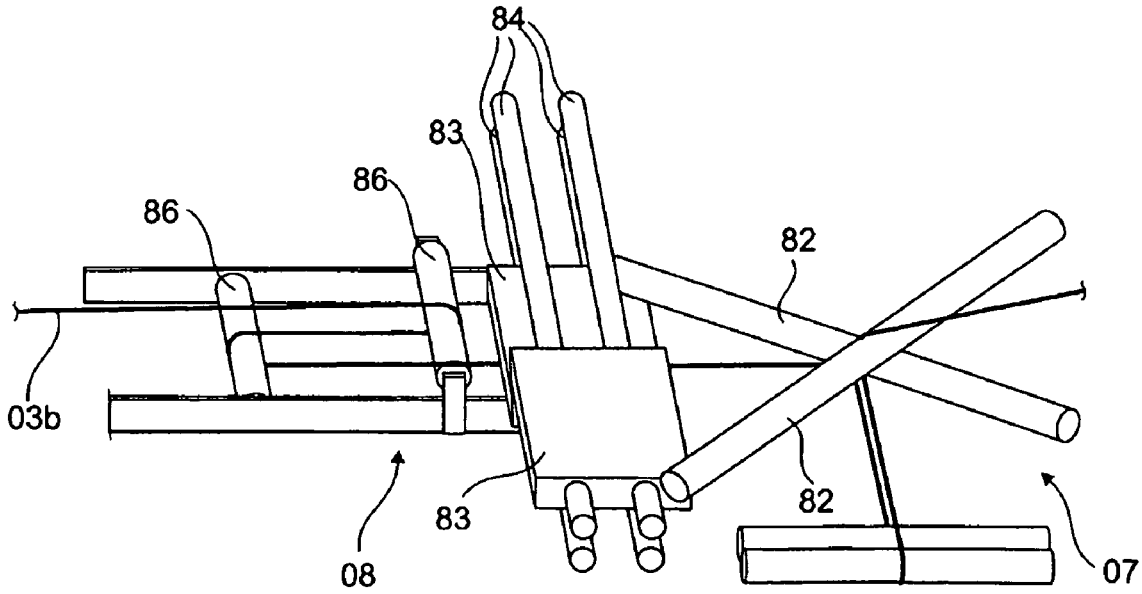

In FIG. 14, the "short" register arrangement 08 is assigned, for example, to one of the "short" turning bars 82 and can be displaced, together with the latter, on the guide element 84 transversely to the direction of the incoming partial web 03*b*. Although this arrangement is represented in FIG. 14 for crossed turning bars 82, it is to be applied to the parallel turning bars 82 shown in FIG. 11. For the case of the turning bars 82 extending crossed, or orthogonally in respect to each other, at least one rerouting roller 97 or as depicted in FIG. 14, two rerouting rollers 97, each with an axis of rotation extending perpendicularly to the axis of rotation of the roller 81, is or are provided.

In an advantageous further development, two such "short" devices, which can be displaced together with the register and turning arrangement 08, 07, or with the register or harp roller 93, are arranged above or below each other per full web 03 in the superstructure 04 of a triple-wide printing press.

The guide elements 84, 96, as seen in FIGS. 13 and 14, of the previously discussed preferred embodiments, can be realized in various ways. For example, the guide elements 84, 96 can be embodied as spindles, each having a screw thread at least over parts of each spindle, and which spindles are rotatably seated on both sides and which can be rotatorily driven, for example, by a drive mechanism, which is not specifically represented. The supports 83, 94 can also be guided in rigid guide elements 84, 96, for example on profiled strips in the manner of sliding blocks. In this case, the support 83, 94 can also be provided by means of a driveable spindle, or in another way.

Various transitions or offsets of partial webs 03*a*, 03*b*, 03*c* over one or two partial web widths, or also over multiples of half a partial web width, are possible by the use of the transversely displaceable turning bar 82. In the course of this, the imprinted partial webs 03*a*, 03*b*, 03*c* are aligned with one of several, here three, formers 101, 102, 103 of the folding structure 11, as seen in FIG. 15, which three formers 101, 102, 103 are arranged side-by-side transversely to the web running direction. The transition takes place, for example, for meeting the requirements for different sizes of individual strands, or for finally intermediate or end products, wherein it is simultaneously intended to perform effective printing with as full as possible web widths.

In an advantageous embodiment, the superstructure 04 has at least (n* (m/2−1) turning arrangements 07 for n full webs 03, 03', for example n printing towers 01, to be imprinted, each with a maximum width b03 of m printed pages. In the case of a printing press of a width of six pages and, for example, three webs 03, 03', or three printing towers 01, per section, six turning arrangements 07 per sector are advantageous.

In an embodiment of a printing press with, for example, two sections of three printing towers 01 each and a total of six webs 03, 03', 03" of a width of four printed pages and intended for four-color imprinting on both sides, at least three turning arrangements 07 per section are arranged.

In an advantageous embodiment of a printing press with, for example, two sections of two printing towers 01 each, and a total of six webs 03, 03', 03" of a width of four printed pages and intended for four-color imprinting on both sides, four turning arrangements 07 per section are arranged, for example. A product of a total size of 96 pages can then be produced in collection operation in this printing press with two sections, or a total of four printing towers 01 and with four webs 03, 03'. Besides the offset of a partial web 03*a*, 03*b*, 03*c* by a whole number multiple of its partial web width b03*a*, a type of operation is advantageous wherein a partial web 03*a*, 03*b*, 03*c* is offset by an odd-numbered multiple of half a partial web width b03*a* and/or former width i.e. the partial web is offset by a factor of 0.5, 1.5, 2.5 as seen in FIG. 15. This offset can take place by the use of long turning bars which are not specifically represented, and which are extending over the total width of the printing press, or the width b03*a* of the entire web 03, but can also advantageously take place by the use of the above described "short" turning bars 82. For example, the turning bars 82 are then arranged, as represented in FIG. 15, in such a way that the turning bar 82, around which the partial web 03*a*, 03*b*, 03*c* is first looped, is aligned over at least the entire width with a subsequent former 101, 102, 103, while the second turning bar 82 is aligned with at least two adjoining halves of two subsequent side-by-side arranged formers 101, 102, 103.

Figure 16:
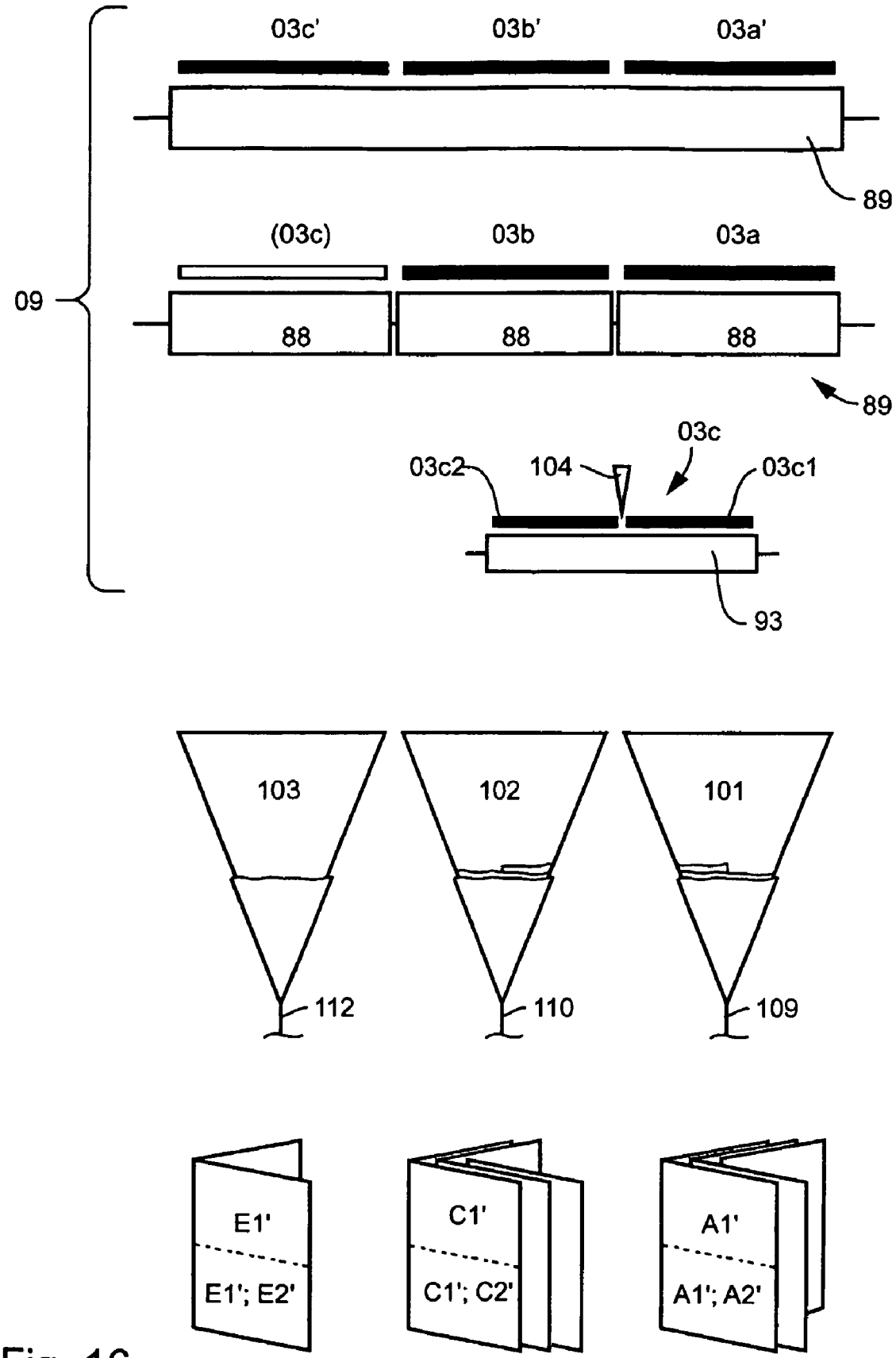

The partial web 03*a*, 03*b*, 03*c*, which is offset by an odd-numbered multiple of half a former width b101, or by a partial web width b03*a*, thus runs "between" the formers 101, 102, 103. This is represented in FIGS. 15 and 16 by the example of the former arrangement of a width of six printed pages at a partial web 03*a*, 03*b*, 03*c* of a width of two pages, but can also be applied to presses of different widths. It is therefore unnecessary to imprint partial webs 03*a*, 03*b*, 03*c*, each of a width of only one printed page, or partial webs 03*a*, 03*b*, 03*c*, each of a width of one-half a former width b101 per se, and to conduct them through the printing press. A large variety in the products is nevertheless possible.

The partial web 03*a*, 03*b*, 03*c*, offset by an odd-numbered multiple of half a partial web width b03*a*, is longitudinally cut upstream of the former 101, 102, 103 in an alignment between the two aligned formers 101, 102, 103 and moves toward the folding structure 11, or the harp 09, i.e. the undivided and/or divided harp roller 89 and/or the "short" harp roller 93 as seen in FIG. 16.

A schematic section of FIG. 15 with harp rollers 89, 93, which by way of example are differently embodied, is represented in FIG. 16 wherein, for example, the partial web 03*c* was offset from it original position, which is represented not darkened or filled out, by one and a half partial web widths b03*a*. If, for example, it is cut by use of a further longitudinal cutting device 104 upstream of the former 101, 102, 103, so as to thereafter be respectively, either one printed page, or one newspaper page wide, each half of it can be conducted with the partial webs 03*a* and 03*b* to a former 101, 102. The two intermediate products then each have, for example, at least one partial web 03*c*1, 03*c*2 of a formerly two printed pages wide partial web 03*a*, 03*b*, 03*c*. In addition, partial webs 03*a*', 03*b*', 03*c*' from other webs 03' imprinted in another printing unit 02, or in another printing tower 01, can run up on one or several of the harp rollers 89, 93. The partial webs 03*a*, 03*a*', 03*c*1, 03*b*, 03*b*', 03*c*2, 03*c*' running aligned above or below each other can now, be combined into respective strands 109, 111, 112, and can be fed to a former 101, 102, 103. Thus, in the preferred embodiment, it is possible to create from two webs 03, 03', each imprinted, for example in four colors on both sides in double-size or triple-size printing units, products or intermediate products, also called booklets or books, with the following number of pages, differing in accordance with the coverage of the forme cylinders 16 and the corresponding mode of operation of the folding apparatus 12. With single production, i.e. the forme cylinder 16 is covered with two printing formes 19 of different printed pages A1, A2 to F1, F2, or A1', A2' to F1', F2' for the second web 03, in the circumferential direction, and with transverse cutting and collection taking place in the folding apparatus 12, respectively two different booklets of ten printed pages each can be created by the strands 109 and 111, and by the strand 112 two different booklets with four pages each can also be formed. A total product has, for example, 48 pages. If this printing press is operated in double production, i.e. the forme cylinder 16 is covered with two printing formes 19 of identical printed pages A1, A1 to F1, or A1', A1' to F1', in the circumferential direction, and no collection takes place in the folding apparatus 12, respectively two identical booklets following each other and with the above mentioned number of pages can be created by the strands 109, 11 and 112. A total product of only 24 pages, but with double yield, is produced.

In a further embodiment, the harp rollers 89, 93, in particular if they are embodied as being undivided over their entire length, can be rotatorily driven by their own, non-represented drive motors. The drive motors for these harp rollers are then embodied controllable, for example with respect to their rpm, and possibly with respect to their position, and are connected with the printing press control device, or with an electronic guide shaft, for accepting desired reference variables.

Figure 17:
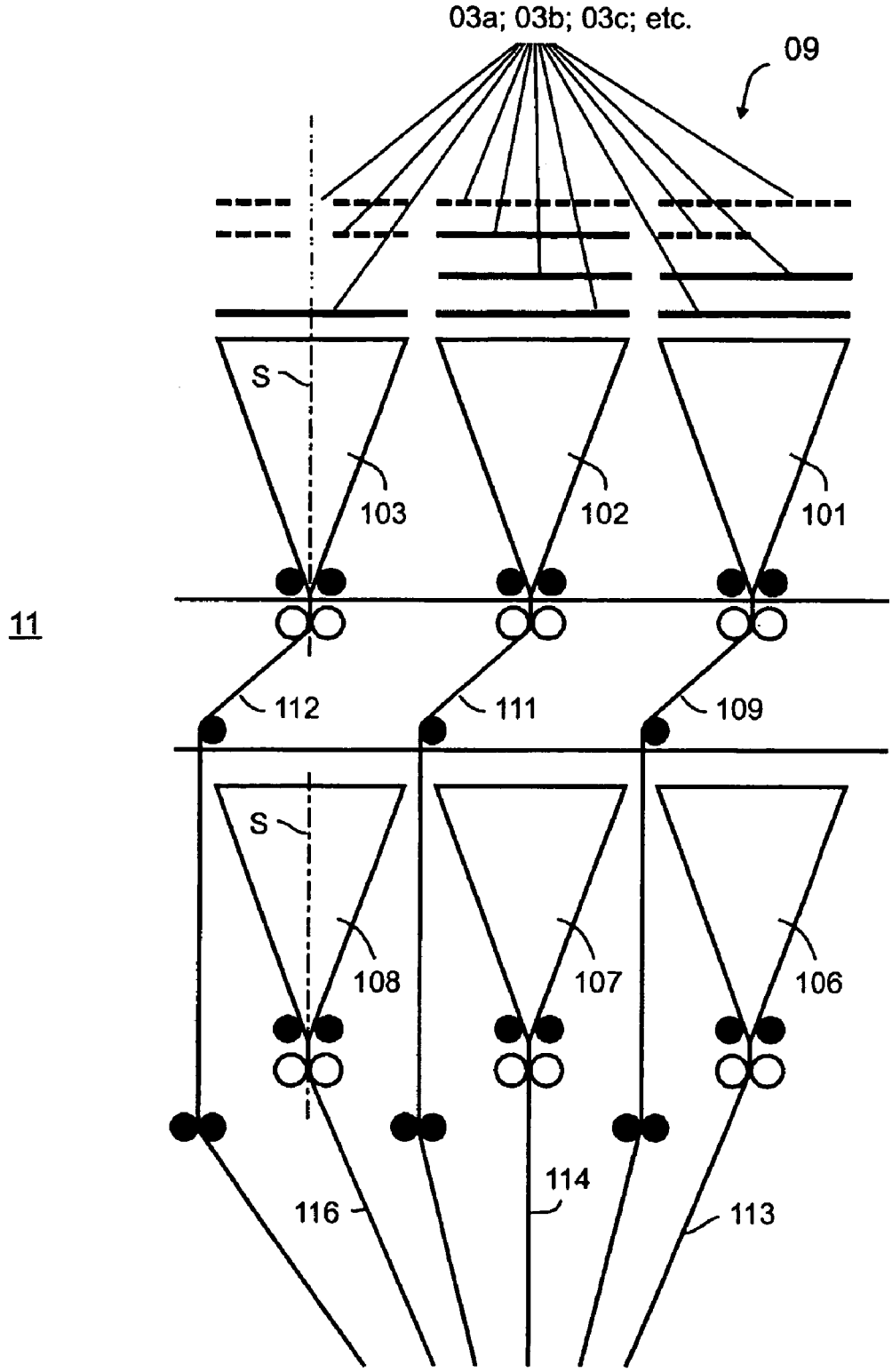

As represented in FIG. 17, the folding structure 11 has at least two formers 101, 106, or 102, 107, or 103, 108 which are arranged one above the other, and whose planes of symmetry S are respectively located in common alignment with a partial web 03*a*, 03*b*, 03*c*, respectively, which partial web is passing, in a straight line, through the printing press. In particular, the planes of symmetry S of the two formers 101, 106, or 102, 107, or 103, 108 arranged one above the other substantially coincide with a center plane M of a partial web 3*a*, 3*b*, 3*c*, 3*a*', 3*b*', 3*c*', or 3*a*", 3*b*", 3*c*", or 3*a*"', 3*b*"', 3*c*"', etc. of a width of two printed pages, running straight and only rerouted in the vertical direction. In FIG. 17, the partial webs 03*a*, 03*b*, 03*c*, etc. are partially drawn in solid lines and are partially represented by dashed lines for reasons to be explained below in connection with FIG. 18.

In accordance with FIG. 17, two groups, each of respectively three formers 101, 102, 103, or 106, 107, 108, which two groups being vertically offset in respect to each other, are arranged for the printing press of a width of six printed pages. For four printed pages wide printing presses, these can be respectively two, for eight printed pages wide printing presses there can be respectively four formers arranged side-by-side in each group. Respectively, one upper former and one lower former 101, 106, or 102, 107, or 103, 108 are aligned with each other in pairs in the above described manner and respectively with a center plane M. The three formers 101, 102, 103, or 106, 107, 108, of each group are arranged aligned with each other side-by-side transversely to the running direction of the partial webs 03*a*, 03*b*, 03*c* and, in an advantageous arrangement, the formers of each group are also positioned all substantially at the same level. However, if desired, they can also be vertically offset with respect to each other and/or can have different dimensions, however, in the latter case they at least partially intersect, for example in the horizontal plane.

Viewed in the running direction of the web, the folding structure 11 has, at least upstream of one of the two groups of formers 101, 102, 103, or 106, 107, 108 which are arranged on top of each other, the harp 09 defining the entry into the former of the webs 03, 03', or of the partial webs 03*a*, 03*b*, 03*c*, i.e. a group of several parallel lead or harp rollers 89, 93, offset in the radial direction in respect to each other, over which the various webs 03, 03', or partial webs 03*a*, 03*b*, 03*c*, or 03*a*', 03*b*', 03*c*', are transferred from the superstructure 04 into the folding structure 11. Downstream of the harp rollers 89, 93 these webs or partial webs are combined into a strand 109, 111, 112, or into several strands 109, 111, 112. The future position of each partial web 03*a*, 03*b*, 03*c*, or 03*a*', 03*b*', 03*c*' in the strand 109, 111, 112, or of their printed pages in the intermediate and/or final product, is already fixed in the harp 09, inter alia, by the selection of the relative position of the web or partial web in respect to the other partial webs 03*a*, 03*b*, 03*c*, or 03*a*', 03*b*', 03*c*' passing through the harp 09. The harp rollers 89, 93 of a harp 09 are offset vertically and/or horizontally with respect to each other and are preferably seated as a modular unit in a common frame. Such a harp 09 can be provided, in principle, for each one of the groups of formers 101, 102, 103, or 106, 107, 108 which are vertically offset from each other.

Figures 1, 19:
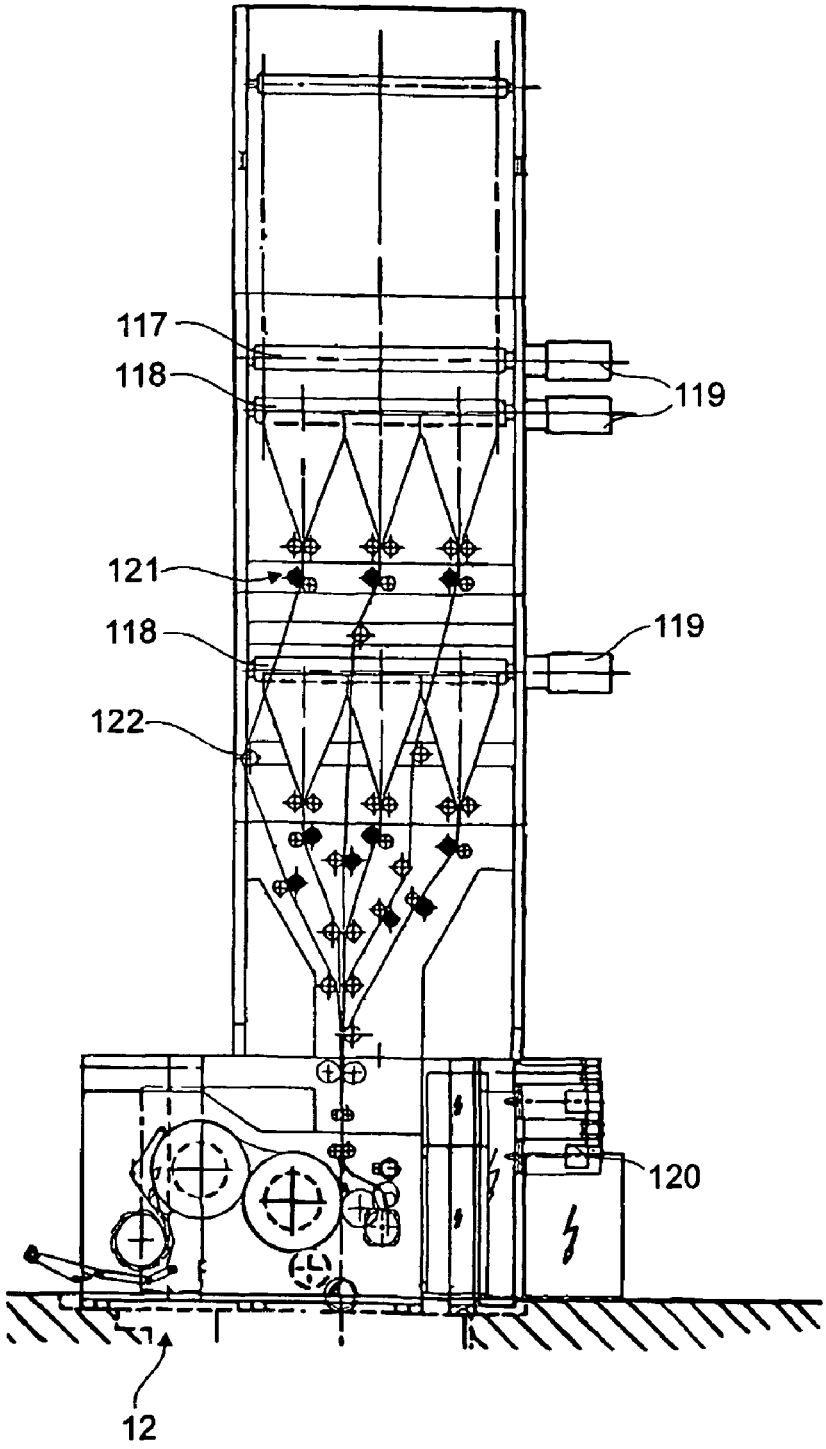

To accomplish a savings in structural height, the two formers 101, 102, 103, or 106, 107, 108, which are arranged on top of each other, but which are aligned with each other in their plane of symmetry, respectively, have a common harp 09 in an advantageous embodiment as represented in FIG. 1 and FIG. 19. For n full webs 03, 03' to be imprinted, for example for n printing towers 01 of a section, each of a maximum web width b03 of m printed pages, the harp 09 has, in an advantageous embodiment, at least (n*m/2) harp rollers 88, 89, 93, whose axes of rotation are located substantially in a common plane, for example, and which harp rollers 88, 89, 93 are preferably seated in a common frame. In the present case of the printing press of a width of six pages and, for example, with two webs 03, 03' or with two printing towers 01, at least six harp rollers 88, 89, 93 for each harp 09 are advantageous.

In an embodiment of a section of a printing press with three printing towers 01 and with three webs 03, 03', 03" intended for four-color printing on both sides, at least nine harp rollers 88, 89, 93 have been arranged per harp 09. During collection operations, a product of a total size of 72 pages can then be created in this section.

In an advantageous embodiment of a printing press with, for example, two sections, each of respectively three printing towers 01 and with a total of four webs 03, 03', 03" of a width of six pages intended for four-color printing on both sides, at least six harp rollers 88, 89, 93 per harp 09 of one section are arranged. These six harp rollers 88, 89, 93 per section, i.e. twelve in this case, can be arranged in two structurally separate harps 09, for example via a common folding structure 11 or two folding structures 11, but also in a structurally common harp 09, for example in two rows. It is then possible to create a product with a total size of 96 pages during collecting operations in this printing press with two sections.

In an advantageous embodiment of a printing press with, for example, two sections each of two printing towers 01 and with a total of four webs 03, 03', 03" of a width of six pages intended for four-color printing on both sides, at least six harp rollers 88, 89, 93 per harp 09 of one section are arranged. These six harp rollers 88, 89, 93 per section, i.e. twelve in this case, can be arranged in two structurally separate harps 09, for example via a common folding structure 11 or two folding structures 11, but also in a structurally common harp 09, for example in two rows. It is then possible to create a product with a total size of 96 pages during collecting operations in this printing press with two sections.

If only one folding structure 11 is provided for two sections, the number of required harp rollers 89, 93 must be determined in accordance with the configuration of the two sections. If the folding structure 11 is arranged between these two sections, either all of the harp rollers 89, 93 are arranged in one row or, for saving structural height, the harp rollers 89, 93 of each section are arranged in a row, and the rows are horizontally offset from each other in the radial direction. The harp rollers 89, 93 of the two rows are here arranged again in a common frame, for example.

If, in fact and as indicated in FIG. 1, two folding structures 11 are provided for the two sections, it can nevertheless be advantageous to provide for at least one of the two harps 09 a number of harp rollers 89, 93, possibly in the two above mentioned rows, which would be required for both sectors. Thus, an even greater amount of flexibility in production size and in production composition is provided. If required, webs 03, 03' imprinted in one section can now be conducted for further processing to the harp 09 of the other section, and vice versa.

Figure 18:
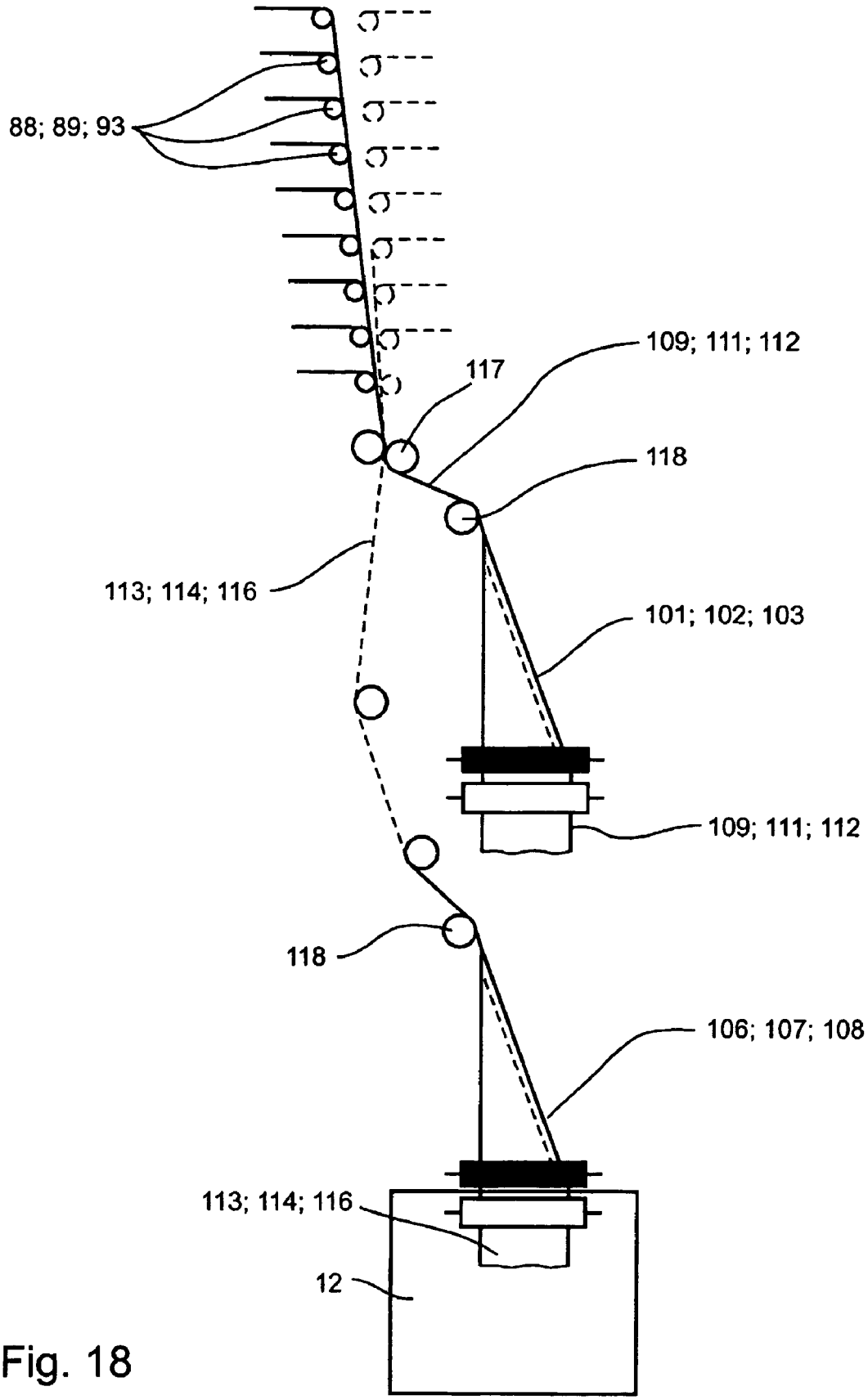

As may be seen in FIG. 18, at least one of the partial webs 03*a*, 03*b*, 03*c*, etc. passing through the common harp 09 arranged upstream of the upper former 101, 102, 103 can be or is conducted to the lower former 106, 107, 108. Depending on the desired size of the individual intermediate products, such as booklets or books, more or fewer of the partial webs 03*a*, 03*b*, 03*c*, etc. are to be transferred to the upper former 101, 102, or 103, or to the lower former 106, 107, or 108. Depending on the production requirement, it is possible, in this way, to send strands 109, 111, 112 to the upper former 101, 102, 103, and strands 113, 114, 116 to the lower former 106, 107, 108, respectively. For example, the partial webs shown in dashed lines in FIG. 17 are conducted as the strand 113, 114, 116 to the former 106, 107, 108, respectively located at the bottom, and the partial webs shown in solid lines in FIG. 17 are conducted to the folder 101, 102, 103, respectively located at the top. In this way, depending on where the "separation" into partial webs 03*a*, 03*b*, 03*c*, etc. from the common harp 09 is located, a flexible production of differently sized intermediate products, such as booklets, books, or end products, is possible with a reduced outlay. A second row of harp rollers 89, 93 is shown in dashed lines in FIG. 18, by the use of which partial webs 03*a*, 03*b*, 03*c*, for example from another section, can also be received, as described above.

In the case of multi-colored products and when using the above-described folding structure 11 with a common harp 09, it is advantageous, with regard to flexibility, to embody all printing units 02 or printing towers 01, or the paths of the web 03, 03' in the same color. For example, the web 03, 03' and/or partial web 03*a*, 03*b*, 03*c* etc., of the printing group 13 can be flexibly selected for a colored cover sheet, and the size of the intermediate products is variable.

The above mentioned folding structure 11 with only one harp 09 for two groups of formers 101, 102, 103, or 106, 107, 108, with the two groups arranged on top of each other, is also suitable for other printing presses with different cylinder widths and cylinder circumferences. Such a folding superstructure 11, consisting of two groups of formers 101, 102, 103, and 106, 107, 108 arranged on top of each other and with a common harp 09, can also be arranged above a third former with its own harp 09. The described folding structure 11 with a harp 09 assigned to several formers 101, 102, 103, 106, 107, 108 vertically offset in respect to each other can also be well applied to three formers 101, 102, 103, 106, 107, 108 arranged on top of each other.

Thus, the outer pages, for example of a book, can be assigned to a defined web course and/or to a defined printing tower/printing unit.

By the use of the harp 09 assigned to several formers 101, 102, 103, 106, 107, 108, it is possible to process the partial webs 03*a*, 03*b*, 03*c*, etc. located on top of each other, in a flexible manner, into books of different size, depending on the desired product, without a large outlay for additional, superfluous offsets of partial webs 03*a*, 03*b*, 03*c*, etc. being required. For example, of four partial webs 03*a*, 03*b*, 03*c*, etc. located on top of each other, it is possible, in one case, to conduct three webs to one former, and one web to the other former 101, 102, 103, 106, 107, 108, while at another time, respectively two partial webs 03*a*, 03*b*, 03*c*, etc. are combined and are conducted to a former 101, 102, 103, 106, 107, 108. It is particularly advantageous that strands 109, 111, 112, 113, 114, 116, which lie side-by-side, can be combined in different sizes, as represented in FIG. 17.

In an advantageous embodiment, traction rollers 117, and former inlet rollers 118, respectively are arranged upstream of the formers 101, 102, 103, 106, 107, 108 and have their own drive motors 119. The same applies to traction rollers 121, shown in FIG. 19, which are also provided in the folding structure 11. In FIG. 19 the traction roller 117 for the lower group of the formers 106, 107, 108 is not visible. The respective drive motor 119 of the traction rollers 121 is represented in FIG. 19 only by darkening-in the respective traction roller 121. In an advantageous embodiment, at least one such driven traction roller 121 is arranged downstream of each of the formers 101, 102, 103, 106, 107, 108, and works, together with pressing rollers, or with one pressing roller, via the strand 109, 111, 112, 113, 114, 116. Besides this, the folding structure 11 preferably has non-driven guide rollers 122, over which the strands 109, 111, 112, 113, 114, 116, each of a width of one printed page, can be conducted.

It is particularly advantageous, for example in a view toward maintaining or setting linear registers, if the folding apparatus 12, as seen in FIGS. 1 and 19, has at least one of its own drive motors 120, which drive motor 120 is independent of the printing units 02. While the drive motors 119 of the traction or of the former inlet rollers 117, 118, 121 of the folding structure 11, and/or of the driven traction rollers 81 of the superstructure 04 need only be embodied to be controlled in respect to a number of revolutions, or can be embodied to be controlled with respect to an angular position, in an advantageous embodiment, the drive motor 120 at the folding apparatus 12 is embodied to be controllable, or to be controlled, with respect to its angular position.

It is thus possible, in an embodiment of the present invention, to preset an angular position in relation to a virtual electronic guide axis in the printing units 02 and the folding apparatus 12, or their drive motors 61, 120, which are driven mechanically independently of each other. In another embodiment, the angular position of, for example the folding apparatus 12, or of its drive motor 120, is determined, and on the basis of this determination, the relative angular position, with respect to it, of the printing units 02, or of the printing groups 13, is preset. The drive motors 80, 119 of the driven rollers 81, 117, 118 which, for example, are only controlled with respect to their number of revolutions, obtain the presetting of their number of revolutions from the printing press control, for example.

By the embodiment of the web-fed rotary printing press with triple wide and double size transfer and forme cylinders, and the corresponding embodiment of the folding structure it is possible by use of a web, for example in double production, to produce a book with twelve pages, or a book with four pages and a book with eight pages, or two books with six pages, or three books with four pages, and further variations.

The number of pages of the intermediate products which are then collected from two longitudinally folded sections are doubled with collection production.

The respective number of pages should be doubled in connection with printing in tabloid format. The dimensioning of the cylinders 16, 17, 18, as well as of the groups of folders 101, 102, 103, 106, 107, 108 should be correspondingly applied to respective "horizontal" printed pages, wherein a section A, B, C has two horizontal printed pages in the circumferential direction, or running direction, of the web 03, 03', 03*a*, 03*b*, 03*c*, so that the forme cylinder 16 then has a circumference corresponding to four horizontal printed pages in tabloid format, for example. The number of printed pages in the longitudinal direction per web 03, 03', 03*a*, 03*b*, 03*c*, or cylinder 16, 17, 18, or former width, remains.

While preferred embodiments of a printing unit and of a rotary web-fed printing press, in accordance with the present invention, have been set forth fully and completely hereinabove, it will be apparent to one of skill in the art that various changes in, for example, the type of web being printed, the particular composition of the printing formes and the dressings, and the like could be made without departing from the true spirit and scope of the present invention, which is accordingly to be limited only by the following claims.

What is claimed is:

1. A printing unit of a web-fed rotary printing press comprising:

at least first and second pairs of two cylinders, each of said two cylinders in each of said at least first and second pairs of two cylinders including a transfer cylinder and an associated forme cylinder, each said transfer cylinder and each said associated forme cylinder having a width for imprinting six newspaper pages arranged axially side-by-side;

at least one dressing on each said transfer cylinder, said at least one dressing having first and second dressing ends;

a shell surface on each said transfer cylinder;

at least one axially extending dressing end receiving opening in said transfer cylinder shell surface, said first and second dressing ends being receivable in said at least one dressing end receiving opening;

a shell surface on each said forme cylinder, each said forme cylinder shell surface having a circumferential length of two vertical newspaper pages;

first and second axially extending printing forme end receiving channels in said shell surface of each said forme cylinder, each said printing forme end receiving channel extending axially over said six newspaper page width of said forme cylinder, said first and second axially extending printing forme end receiving channels being spaced from each other in a circumferential direction on said shell surface of each said forme cylinder;

a plurality of printing formes on each said forme cylinder and arranged axially side-by-side on plurality of sections of said shell surface of each said forme cylinder and at least two of said plurality of printing formes being arranged one behind the other in said circumferential direction of each said forme cylinder;

at least one drive motor for each of said at least first and second pairs of said cylinders, each said drive motor driving its pair of cylinders independently; and at least one printing forme pressing device having six first pressing roller elements associated with at least one of said forme cylinders, said six first pressing roller elements being movable independently of each other and each being engageable with one of said six printing formes of said associated one of said forme cylinders during rotation of said associated one of said forme cylinders.

2. The device of claim 1 wherein said transfer cylinders act together and form a double print position in a print-on position.

3. The device of claim 1 further including a satellite cylinder acting with said two transfer cylinders.

4. The device of claim 1 wherein each said transfer cylinder has a barrel length of between 1850 mm and 2400 mm and has a circumference of between 850 mm and 1300 mm.

5. The device of claim 1 wherein each said transfer cylinder shell surface has three of said dressings arranged side-by-side in said axial direction.

6. The device of claim 5 wherein said three dressings are arranged circumferentially offset with respect to each other.

7. The device of claim 6 wherein each of said three dressings is offset by 180° with respect to its axially adjacent dressing.

8. The device of claim 1 wherein each said forme cylinder has at least three of said printing formes arranged side-by-side in said axial direction and two of said printing formes arranged in said circumferential direction.

9. The printing unit of claim 1 wherein said at least one printing forme pressing device includes at least one group of several of said pressing roller elements which can be moved independently of each other.

10. The printing unit of claim 1 wherein said six first pressing roller elements are aligned side-by-side in said axial direction of said associated one of said forme cylinders.

11. The printing unit of claim 1 further including printing forme holding devices in each said printing forme end receiving channel, said holding devices being actuated by a common actuating means.

12. The printing unit of claim 1 wherein each said printing unit is part of a web-fed rotary printing press.

* * * * *

UNITED STATES PATENT AND TRADEMARK OFFICE

CERTIFICATE OF CORRECTION

PATENT NO. : 7,448,320 B2
APPLICATION NO. : 11/589105
DATED : November 11, 2008
INVENTOR(S) : Bernd Kurt Masuch et al.

It is certified that error appears in the above-identified patent and that said Letters Patent is hereby corrected as shown below:

Col. 24, Line 31, after “on”, change “plurality of” to --six--; and
Col. 24, Line 44, Delete “six” insert --plurality of--.

Signed and Sealed this

Seventh Day of April, 2009

JOHN DOLL
*Acting Director of the United States Patent and Trademark Office*